US006935504B2

(12) United States Patent
Ritter et al.

(10) Patent No.: US 6,935,504 B2
(45) Date of Patent: Aug. 30, 2005

(54) PASSIVE INTERLOCK STRUCTURE

(75) Inventors: Karl M. Ritter, Geneva, IL (US); Michael B. McLeod, Romeoville, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 89 days.

(21) Appl. No.: 10/273,661

(22) Filed: Oct. 18, 2002

(65) Prior Publication Data

US 2004/0074801 A1 Apr. 22, 2004

(51) Int. Cl.[7] ..... B65D 21/00
(52) U.S. Cl. ..... 206/511; 206/512
(58) Field of Search ..... 229/DIG. 11; 206/508, 206/511, 503, 509, 512

(56) References Cited

U.S. PATENT DOCUMENTS

| | | | | |
|---|---|---|---|---|
| 2,440,836 | A | 5/1948 | Turngren | 46/25 |
| 2,583,672 | A | 1/1952 | Storey | 229/40 |
| 2,719,664 | A | 10/1955 | Hster | 229/23 |
| 2,744,675 | A | 5/1956 | Crane | 229/27 |
| 2,893,621 | A | 7/1959 | Harnish et al. | 229/34 |
| 2,913,162 | A | 11/1959 | Goltz | 229/27 |
| 2,914,235 | A | 11/1959 | Jones | 229/34 |
| 2,917,223 | A | 12/1959 | Le Bolt et al. | 229/53 |
| 3,015,431 | A | 1/1962 | Mulcoy | 229/45 |
| 3,017,064 | A | 1/1962 | Davis | 229/16 |
| 3,047,157 | A | 7/1962 | Bergman | 211/126 |
| 3,070,257 | A | 12/1962 | Bojanowski | 220/97 |
| 3,103,278 | A | 9/1963 | Kuzma | 206/65 |
| 3,114,495 | A | 12/1963 | Grooms | 229/38 |
| 3,157,345 | A | 11/1964 | George | 229/23 |
| 3,197,109 | A | 7/1965 | Nelson | 229/37 |
| 3,287,075 | A | 11/1966 | Batke et al. | 312/108 |
| 3,363,824 | A | 1/1968 | Murata | 229/27 |

(Continued)

FOREIGN PATENT DOCUMENTS

| | | |
|---|---|---|
| CA | 695608 | 10/1964 |
| DE | 42 00 799 | 9/1992 |
| EP | 0 031 733 A1 | 7/1981 |
| EP | 0 527 066 B1 | 2/1993 |
| EP | 0 567 412 A1 | 10/1993 |
| FR | 936 223 | 7/1948 |
| FR | 1 232 518 | 10/1960 |
| FR | 1 343 060 | 10/1963 |
| FR | 2 128 080 | 10/1972 |
| FR | 2 240 156 | 3/1975 |
| FR | 2 267 958 | 11/1975 |
| FR | 2 299 230 | 8/1976 |
| FR | 2 311 717 | 12/1976 |
| FR | 2 542 713 | 9/1984 |
| GB | 955 006 | 4/1964 |
| GB | 1 293 911 | 10/1972 |
| GB | 2 201 663 | 9/1988 |
| NL | 77007425 B | 7/1977 |
| SU | 0 734 084 | 5/1980 |
| WO | WO 88/02724 | 4/1988 |

*Primary Examiner*—Jacob K. Ackun, Jr.
(74) *Attorney, Agent, or Firm*—Armstrong Teasdale LLP

(57) ABSTRACT

A passive interlock structure for use in containers (such as cartons and trays), particularly those fabricated from corrugated paperboard and the like, which permits the facilitated aligning of vertically stacked containers. The passive interlock structure feature includes recesses formed in the tops or bottoms of the containers, and corresponding complementary low planar projections in the bottoms or tops of the containers.

21 Claims, 21 Drawing Sheets

U.S. PATENT DOCUMENTS 3,462,062 A 8/1969 Miller ..... 229/8
3,473,690 A 10/1969 Cazenove ..... 220/22
3,570,697 A 3/1971 Langston ..... 217/42
3,572,577 A 3/1971 Dorfman ..... 229/32
3,580,475 A 5/1971 Mobley ..... 229/34
3,744,707 A 7/1973 Ross ..... 229/35
3,790,019 A 2/1974 Murray et al. ..... 220/16 R
3,820,706 A 6/1974 Gibson et al. ..... 229/34 R
3,937,390 A 2/1976 Winkler ..... 229/23 R
3,971,300 A 7/1976 Bachner ..... 93/36.3
4,000,841 A 1/1977 Bachili ..... 224/48 R
4,155,451 A 5/1979 Miller ..... 206/503
4,176,747 A 12/1979 Aho ..... 206/509
4,244,472 A 1/1981 Brown ..... 206/597
4,244,509 A 1/1981 Dlugopolski ..... 229/36
4,261,503 A 4/1981 Lawrence et al. ..... 229/37
4,356,952 A 11/1982 Rekow ..... 229/34
4,383,636 A 5/1983 Chaffers ..... 229/32
4,529,088 A 7/1985 Quong ..... 206/509
4,537,344 A 8/1985 Thomas ..... 229/34 R
4,660,725 A 4/1987 Fishman et al. ..... 206/509
4,708,253 A 11/1987 Mednis ..... 215/10
4,709,852 A 12/1987 Stoll ..... 220/119
4,757,910 A 7/1988 Box ..... 229/71
4,830,282 A 5/1989 Knight, Jr. ..... 229/135
4,984,734 A 1/1991 Zion et al. ..... 229/109
5,022,582 A 6/1991 Ritter ..... 229/157
5,039,002 A 8/1991 Spamer ..... 229/120.08
5,052,615 A 10/1991 Ott et al. ..... 229/182
5,361,976 A 11/1994 Blomfield ..... 229/148
5,370,303 A 12/1994 Fry ..... 229/143
5,452,803 A 9/1995 Stromberg ..... 206/507
5,549,241 A 8/1996 Correll ..... 229/120.01
5,662,508 A 9/1997 Smith ..... 446/128
5,704,193 A 1/1998 Roe et al. ..... 53/397
5,765,746 A 6/1998 Peasley et al. ..... 229/104
6,029,886 A 2/2000 Sheffer ..... 229/168
6,092,659 A 7/2000 Peasley et al. ..... 206/508
6,098,873 A 8/2000 Sheffer ..... 229/178
6,234,385 B1 5/2001 Espinoza et al. ..... 229/122
6,257,411 B1 7/2001 Bacques et al. ..... 206/511
6,354,487 B1 3/2002 Muise, Jr. ..... 229/125.28

PASSIVE INTERLOCK STRUCTURE

BACKGROUND OF THE INVENTION

1. Field of the Invention

The present invention is directed to containers and trays that are intended to be stacked, in particular containers (including enclosed cartons, and open and partially closed trays—collectively referred to herein as "containers") that are fabricated from folded blanks of material, such as corrugated paperboard material and the like. Specifically, the present invention is directed to mechanisms for providing positive aligning of stacked containers.

2. Prior Art

Stackable containers fabricated from folded, originally flat blanks of material, such as corrugated paperboard and the like, are known. Typically, however, when such containers are provided with smooth, essentially featureless upper and lower surfaces, then there is a possibility of relative lateral sliding or displacement between adjacent vertically stacked ones of such containers or trays.

Accordingly, it has become desirable to provide a means for aligning such adjacent vertically stacked ones of such containers, to inhibit such relatively lateral sliding or displacement.

Such prior art means for aligning adjacent vertically stacked ones of containers typically have been provided in the form of prominently upwardly (or downwardly) projecting tabs, which are configured to surround upwardly (or downwardly) adjacent containers or trays (e.g., in a nesting fashion), or to be received in corresponding slots, notches or apertures (generally, "receptacles") in the upwardly (or downwardly) adjacent containers.

Such prominently projecting tabs are recognized as being effective in providing assurance of the aligned stacking of containers, but require a concerted effort of lifting one container precisely above another like container, above the height of the projecting tabs, and then lowering the container in a relatively precise manner, to assure proper alignment and engagement of the tabs.

It would be desirable to have a way to provide for rapid and accurate aligned stacking of containers, but without the use of prominently projecting tabs that require relatively precise placement.

These and other desirable characteristics of the invention will become apparent in light of the present specification, including claims, and drawings.

SUMMARY OF THE INVENTION

The present invention is directed, in part, to a container, formed from an articulated, initially flat blank of container material. The container comprises a bottom panel; at least one side panel, emanating from a side edge region of the bottom panel and having a first fold line extending at least partially therebetween; at least one end panel, emanating from an end edge region of the bottom panel and having a second fold line extending at least partially therebetween, and the second fold line extending in an intersecting direction with respect to the first fold line; at least one at least partial top panel, disposed opposite and at least substantially parallel to the bottom panel; and a passive interlock structure disposed in the bottom panel and the at least partial top panels, for enabling at least a region of the bottom panel of a first such container to be complementarily interfitted with at least a region of an at least partial top panel of a second such container.

The passive interlock structure is operably configured so that a first such container can be stacked in an aligned manner atop a second such container, without requiring the first container to be raised substantially above, precisely aligned with and then placed directly down upon the second container. The passive interlock structure further inhibits relative lateral movement therebetween the first and second containers, once such aligned stacking is attained.

In an embodiment of the invention, the passive interlock structure comprises at least one recess, formed in one of the bottom panel and the at least partial top panel of a container, the recess having a planar, substantially transversely extending portion, extending substantially parallel to and vertically offset from the one of the bottom panel and the at least partial top panel; and at least one substantially planar projection, formed in a corresponding one of the at least partial top panel and the bottom panel of the container, the substantially planar projection having a substantially transversely extending portion, extending substantially parallel to and vertically offset from the one of the at least partial top panel and the bottom panel. The at least one recess is disposed opposite to, and in vertically spaced alignment with the at least one substantially planar projection, the at least one recess and the at least one substantially planar projection being further complementarily contoured, so that the at least one substantially planar projection of a first such container can be received within the at least one recess of a second such container stacked and aligned relative thereto.

In an embodiment of the invention, the at least partial top panel emanates from a top edge region of a side panel, and has a third fold line extending at least partially therebetween, and further has an end panel emanating from an end edge region thereof, with a fourth fold line extending at least partially therebetween, the fourth fold line extending in an intersecting direction with respect to the third fold line; wherein each said at least one recess is formed by a die cut through the blank of container material, extending across a corner portion of one of the bottom panel and the at least partial top panel, the die cut extending to and through one of the first and second, or third and fourth fold lines, into the side and end panels adjacent said one of said bottom panel and said at least partial top panel; and secondary fold lines, extending at an acute angle with respect to each of the first and second, or third and fourth, fold lines, the secondary fold lines being disposed in the side and end panels adjacent the corner portion of the one of the bottom panel and the at least partial top panel.

Upon folding of the side and end panels adjacent to said one of the bottom panel and the at least partial top panel, relative to said one of the bottom panel and the at least partial top panel, the die cut, the first and second or third and fourth fold lines, and the secondary fold lines cooperate to move the corner portion of the one of the bottom panel and the at least partial top panel out of plane with respect to a remaining portion of the one of the bottom panel and the at least partial top panel, toward an interior region of the container. The die cut may be one of substantially straight, arcuate.

In an embodiment of the invention, wherein the at least partial top panel emanates from a top edge region of a side panel, and has a third fold line extending at least partially therebetween, and further has an end panel emanating from an end edge region thereof, with a fourth fold line extending at least partially therebetween, the fourth fold line extending in an intersecting direction with respect to the third fold line; wherein each at least one substantially planar projection, formed in a corresponding one of the at least partial top panel and the bottom panel of the container, is formed by a die cut through the blank of container material, extending across a corner portion of one of the bottom panel and the at least partial top panel, the die cut extending to one of the first and second, or third and fourth fold lines, into the side and end panels adjacent said one of said bottom panel and said at least partial top panel; and secondary fold lines, extending at an acute angle with respect to each of the first and second, or third and fourth, fold lines, the secondary fold lines being disposed within the corner portion of the one of the bottom panel and the at least partial top panel, between the first and second, or third and fourth fold lines.

Upon folding of the side and end panels adjacent to said one of the bottom panel and the at least partial top panel, relative to said one of the bottom panel and the at least partial top panel, the die cut, the first and second or third and fourth fold lines, and the secondary fold lines cooperate to move the corner portion of the one of the bottom panel and the at least partial top panel out of plane with respect to a remaining portion of the one of the bottom panel and the at least partial top panel, away from an interior region of the container. The die cut may be one of substantially straight, arcuate.

In an embodiment of the invention, wherein the at least one at least partial top panel emanates from a top edge region of a side panel, and has a third fold line extending at least partially therebetween, and further has an end panel emanating from an end edge region thereof, with a fourth fold line extending at least partially therebetween, the fourth fold line extending in an intersecting direction with respect to the third fold line; wherein each at least one substantially planar projection, formed in a corresponding one of the at least partial top panel and the bottom panel of the container, is formed by the at least partial top panel comprising a web of blank material extending across only a corner portion of the top region of the container, leaving a central region of the top region of the container open and unenclosed, so that the at least partial top panel extends above and is not coplanar with top edges of adjacent side and end panels of the container.

In such an embodiment of the invention, wherein the web of material may have a free edge facing an interior region of the container that is one of substantially straight, arcuate.

The container may be a wraparound style of container having one complete top panel and one complete bottom panel. The container may be a wraparound style of container having a complete bottom panel, and two substantially half-top panels. The container may be a substantially open-topped tray, which may be provided with corner reinforcing panels. The container may further comprise at least one stacking tab aperture.

The present invention is also directed to a passive interlock structure for enabling the facilitated aligned stacking of containers, wherein the containers each include a bottom panel, at least one side panel, at least one end panel, and at least one at least partial top panel disposed opposite and at least substantially parallel to the bottom panel.

The passive interlock structure preferably comprises at least one recess, formed in one of the bottom panel and the at least partial top panel of a container, the recess having a planar, substantially transversely extending portion, extending substantially parallel to and vertically offset from the one of the bottom panel and the at least partial top panel; and at least one substantially planar projection, formed in a corresponding one of the at least partial top panel and the bottom panel of the container, the substantially planar projection having a substantially transversely extending portion, extending substantially parallel to and vertically offset from the one of the at least partial top panel and the bottom panel. The at least one recess is disposed opposite to, and in vertically spaced alignment with the at least one substantially planar projection, the at least one recess and the at least one substantially planar projection being further complementarily contoured, so that the at least one substantially planar projection of a first such container can be received within the at least one recess of a second such container stacked and aligned relative thereto. The passive interlock structure is preferably operably configured so that a first container incorporating the passive interlock structure can be stacked in an aligned manner atop a second like container, without requiring the first container to be raised substantially above, precisely aligned with and then placed directly down upon the second container. The passive interlock structure further inhibits relative lateral movement therebetween such first and second containers, once such aligned stacking is attained.

The at least one recess may be located in a corner region of one of the top and bottom, and the at least one substantially planar projection is located in a corner region of one of the bottom and top, respectively, of a container.

DETAILED DESCRIPTION OF THE DRAWINGS

Figure 1A:
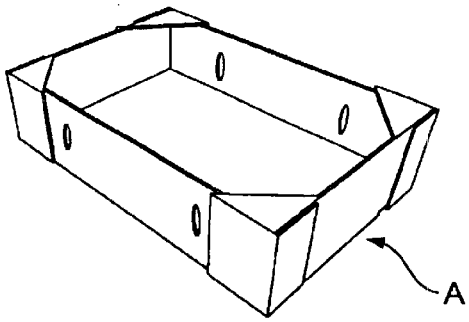
FIG. 1*a* is a top perspective view of an open-topped tray (a "double corner glued tray") incorporating the passive interlock system of the present invention.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

In the figures, unless otherwise noted, the usual convention is observed that solid lines on the interior of a flat blank represent cuts, edges or points of inflection (like a ridge, crease or inwardly or outwardly projecting gusset), and broken or dashed lines indicate folds, score lines or other lines of weakness. While in the various figures, the preferred direction of run of corrugations (presuming the blanks are fabricated from corrugated paperboard material) is indicated, it is to be understood that different corrugation directions, and different blank materials, may be employed if desired.

The basic premise underlying the passive interlock system is that a carton or tray (generally, "container") may be provided with relief features at the corners of the upper and lower surfaces of the container, which provide for a semi-automatic alignment function to facilitate the stacking of identical ones of such containers, without having to employ prominently projecting stacking tabs and corresponding receiving apertures, slots or notches. Such structures required a positive intentional effort at alignment of the containers.

Typically, the relief features of the present invention will employ cuts in the bottom panel of, e.g., a carton, which result in corner portions of the bottom panel being raised or lowered, in a rather sharply defined manner, with respect to the remaining central portion of the bottom panel. Complementary portions of the top panel(s) or merely diagonal regions of the top of the carton are correspondingly lowered or raised, so that when one carton is placed atop another, unless the complementary raised/lowered corner regions are aligned, the side walls of the respective trays will not be aligned, and the upper tray will not sit "flat" on the lower tray. However, unlike a container having prominently projecting stacking tabs and corresponding notches, alignment of containers featuring passive interlock does not require that the upper container be lifted above and then precisely placed down on the lower container for alignment. Rather, a simple lateral back and forth movement quickly results in the alignment and registration of the complementary raised/lowered portions of the respective containers.

Various styles and subvariations of containers may be employed as possible vehicles for the passive interlock system. These styles and subvariations can include, among other styles of containers: 1) a harness wraparound carton with straight diagonal offset cuts; 2) an open-topped double-corner glued tray having straight diagonal offset cuts; 3) a double-corner glued tray with arcuate offset cuts; 4) a similar tray with stacking tabs for increased lateral stability. As long as the upper and lower offset cuts on each container are complementary, the specific pattern or contour of the cuts is not crucial, although symmetry may be desirable, for enhanced manufacturability and versatility.

FIGS. 1*a*–1*f* and 2 illustrate perspective views of some of the various styles and subvariations discussed above. An exhaustive illustration is of course, not possible, as the passive interlock feature can be applied to a wide variety of cartons or trays, apart from those illustrated and described herein.

Figure 1B:
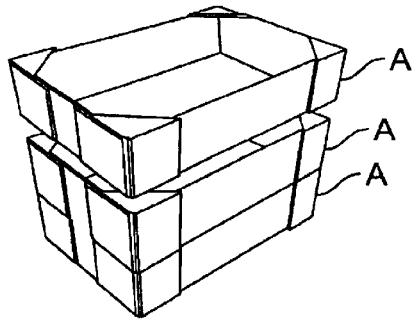
FIG. 1*b* is a top perspective view of a plurality of stacked trays of the kind illustrated in FIG. 1*a*.
Figure 1C:
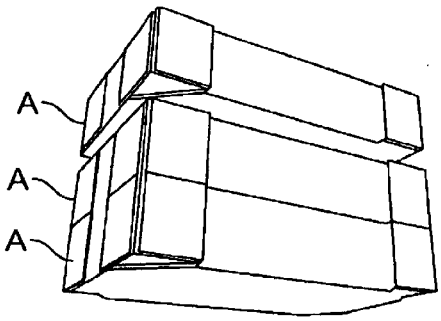
FIG. 1*c* is a bottom perspective view of a plurality of stacked trays of the kind illustrated in FIG. 1*a*.
Figure 2:
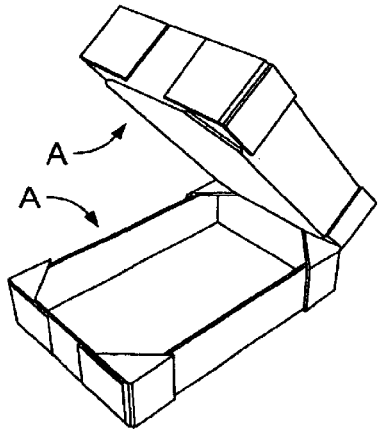
FIG. 2 is a further perspective view of a pair of trays, such as are illustrated in FIGS. 1*a*–1*c*.

FIG. 1*a* is a top perspective view of an open-topped tray A (a "double corner glued tray") incorporating the passive interlock system of the present invention. FIG. 1*b* is a top perspective view of a plurality of stacked trays A of the kind illustrated in FIG. 1*a*. FIG. 1*c* is a bottom perspective view of a plurality of stacked trays A of the kind illustrated in FIG. 1*a*. FIG. 2 is a further perspective view of a pair of trays A, such as are illustrated in FIGS. 1*a*–1*c*.

Figure 1D:
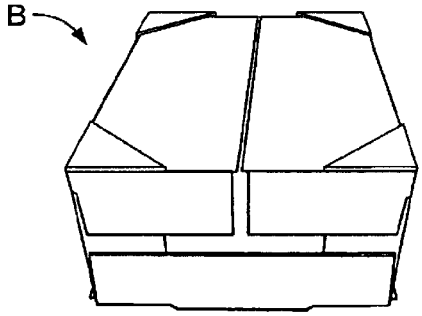
FIG. 1*d* is a top perspective view of a harness-style wraparound container incorporating the passive interlock system of the present invention.

FIG. 1*d* is a top perspective view of a harness-style wraparound container B incorporating the passive interlock system of the present invention.

Figure 1E:
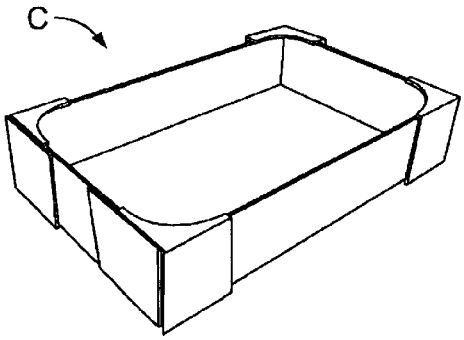
FIG. 1*e* is a top perspective view of an open-topped tray (a "double corner glued tray") incorporating the passive interlock system of the present invention, using arcuate interlock surface features.
Figure 1F:
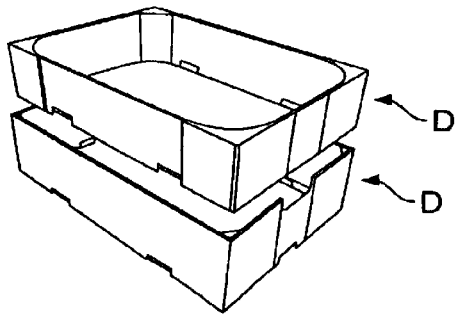
FIG. 1*f* is a top perspective view of a plurality of stacked trays of the kind illustrated in FIG. 1*e*, with the trays further incorporating stacking tabs and complementary stacking tab receptacles.

FIG. 1*e* is a top perspective view of an open-topped tray C (a "double corner glued tray") incorporating the passive interlock system of the present invention, using arcuate interlock surface features. FIG. 1*f* is a top perspective view of a plurality of stacked trays of the kind illustrated in FIG. 1*e*, with the trays further incorporating stacking tabs and complementary stacking tab receptacles.

Figure 3:
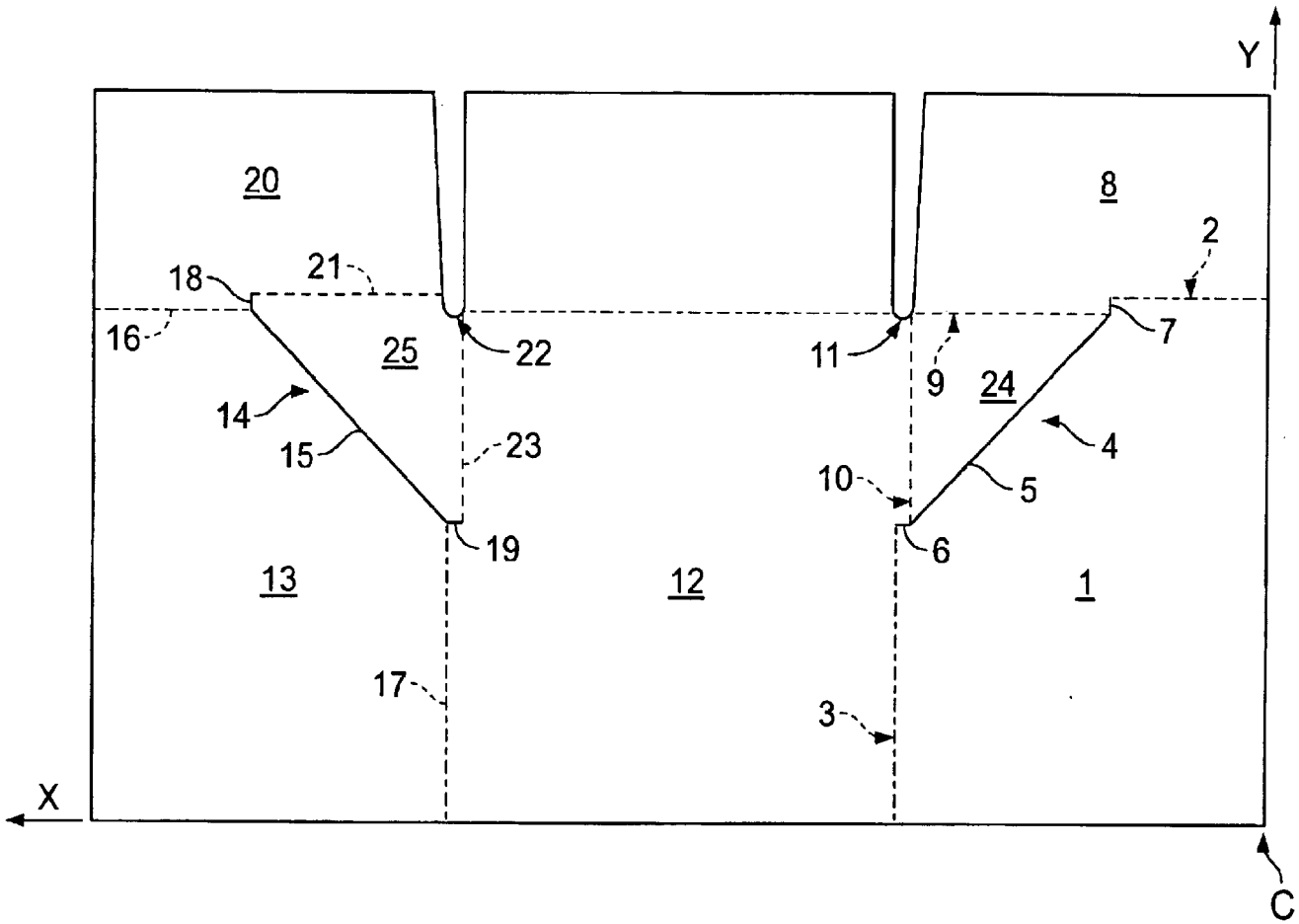
FIG. 3 illustrates in a simplified, fragmentary form, how one end of a container blank may be die cut and scored, to achieve the passive interlock, according to the principles of the present invention.

FIG. 3 illustrates in a simplified, fragmentary form, how one end of a container blank may be die cut and scored, to achieve the passive interlock. If the fragmentary blank of FIG. 3 were to be shown in full, it could represent, for example, a blank for a harness wraparound-type carton, such as that shown in FIG. 1*d*, in which there is a single bottom panel, and there are two top half panels, which may or may not abut at their free edges.

Panel 1 is part (e.g., a quarter) of a bottom panel of a container, such that the whole blank would have a center of symmetry at c, and would be symmetrical about axes x and y. Scores 2 and 3 define one end and one side edge of panel 1, respectively. Cut 4 includes diagonal portion 5 and two orthogonal portions 6 and 7. Bottom flap 8 emanates from bottom panel 1, along score 2 and score 9. The particular positioning of scores 9 and 10, with respect to scores 2 and 3, respectively, is crucial to the operation of the passive interlock system. If scores 2, 3, were to be extended to corner 11, each of scores 9 and 10 would be seen to angle away from those extensions of scores 2, 3, at shallow acute included angles, with scores 9 and 10 being situated entirely within the boundaries of panel 1. The inner ends of scores 9 and 10 terminate at approximately the intersections of orthogonal portions 7, 6 with diagonal portion 5 of cut 4.

Panel 12 forms a side panel connecting bottom panel 1 and top panel 13. In top panel 13, cut 14 includes diagonal portion 15 (which extends from score 16 to score 17) and orthogonal portions 18 (which extends into top flap 20) and 19 (which extends into side panel 12). Score 21 extends from corner region 22 to the end of orthogonal portion 18. Score 23 extends from corner region 22 to the end of orthogonal portion 19. If scores 16 and 17 were to be extended to corner 19, each of scores 21 and 23 would be seen to angle away from those extensions of scores 16 and 17, respectively, at shallow acute included angles, with scores 21 and 22 being positioned in panels 20 and 12, respectively, substantially entirely outside of panel 13. Thus, it is seen that the patterns of scores and cuts associated with, e.g., bottom panel 1, are not identical or mirror images of the cuts and scores associated with the top panel 13, but rather are complementary to them.

In operation, when the blank is articulated into a container, first by folding panels 12 and 8 perpendicular to panel 1 (i.e., toward the viewer of FIG. 1), because of the presence of the orthogonal portions 6 and 7, and the angled, offset scores 9 and 10, generally triangular panel 24 is forced downward (away from the viewer), with respect to the remainder of panel 1. That is, panel 24 would tend to move away from the interior of the resultant container, with respect to the remainder of panel 1. Conversely, when panel 13 is subsequently folded perpendicular to panel 12, and panel 20 is folded perpendicular to panel 13, generally triangular panel 25 would be forced upwardly (toward the viewer), with respect to the remainder of panel 13. That is, panel 25 would tend to move toward the interior of the resultant container, with respect to the remainder of panel 1.

Thus, the bottom of the container will have four downwardly, outwardly projecting planar triangular portions at the corners, while the top of the container will have four downwardly, inwardly projecting planar triangular portions at the corners, configured to receive and interlock with the downwardly projecting planar triangular portions of a like container placed atop the first.

Figure 4:
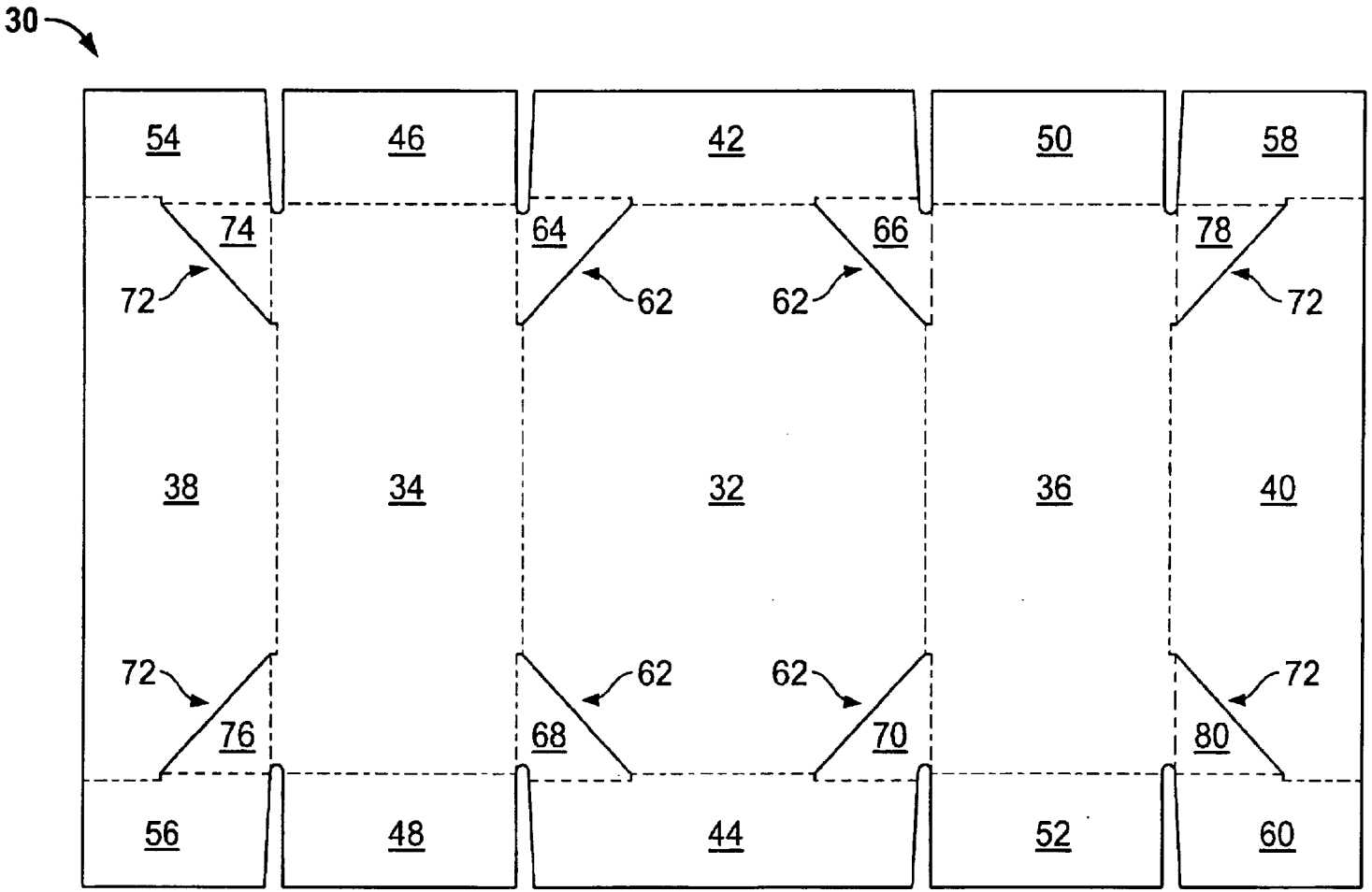
FIG. 4 illustrates a center seam wrap blank, that is similar to the blank that would result from FIG. 3, except that the orientations of the scores and cuts for the passive interlock are reversed, with respect to the top and bottom of the resultant container.

FIG. 4 illustrates a center seam wrap blank, that is similar to the blank that would result from FIG. 3, except that the orientations of the scores and cuts for the passive interlock are reversed, with respect to the top and bottom of the resultant container. The articulation of the blank, apart from the formation and operation of the interlock regions, may be the same as for such wrap blanks as may be known in the art.

Blank 30 includes bottom panel 32; side panels 34, 36; top panels 38, 40; and flaps 42, 44, 46, 48, 50, 52, 54, 56, 58 and 60. Blank 30 is provided with four "recess" type interlock regions 62, each of which is configured, and operates similarly to the interlock region on the left side of FIG. 3. That is, the diagonal cuts in panel 32 extend perpendicularly across the "boundary" of panel 32, with orthogonal cuts extending into the adjacent panels 34, 36 and flaps 42, 44. The "angled" score lines, which help create the "recess" interlock effect are provided, not in the bottom panel, but in the adjacent panels and flaps. Upon folding up (i.e., toward the observer of FIG. 4) of panels 34 and 36, and flaps 42 and 44, triangular sections 64, 66, 68 and 70 likewise will be pulled up, out of the plane of panel 32, and toward the observer of FIG. 4.

Blank 30 is likewise provided with four complementary "projection" type interlock regions 72, each of which is configured, and operates similarly to the interlock region of the right side of FIG. 3. That is, the diagonal cuts in panels 38, 40, not extend to the "boundaries" of panels 38, 40, but instead terminate in orthogonal cuts that run just to the boundaries of the panels. The "angled" fold lines, which cause the "projection" interlock effect are situated within panels 38, 40. Upon folding of panels 38, 40 about their respective fold lines along panels 34, 36, and upon folding of flaps 54, 56, 58, 60, about their respective fold lines along panels 38, 40 (i.e., toward the viewer), triangular sections 74, 76, 78 and 80 will be pushed out of the planes of panels 38, 40 and "away" from the observer.

Thus, the bottom of the container formed by blank 30 will have four upwardly, outwardly projecting planar triangular sections at the corners of the top panels, while the bottom of the container will have four upwardly, inwardly projecting planar triangular sections at the corners of the bottom panel, configured to receive and interlock with upwardly projecting planar triangular sections of a like container upon which the first container would be stacked.

Figure 5:
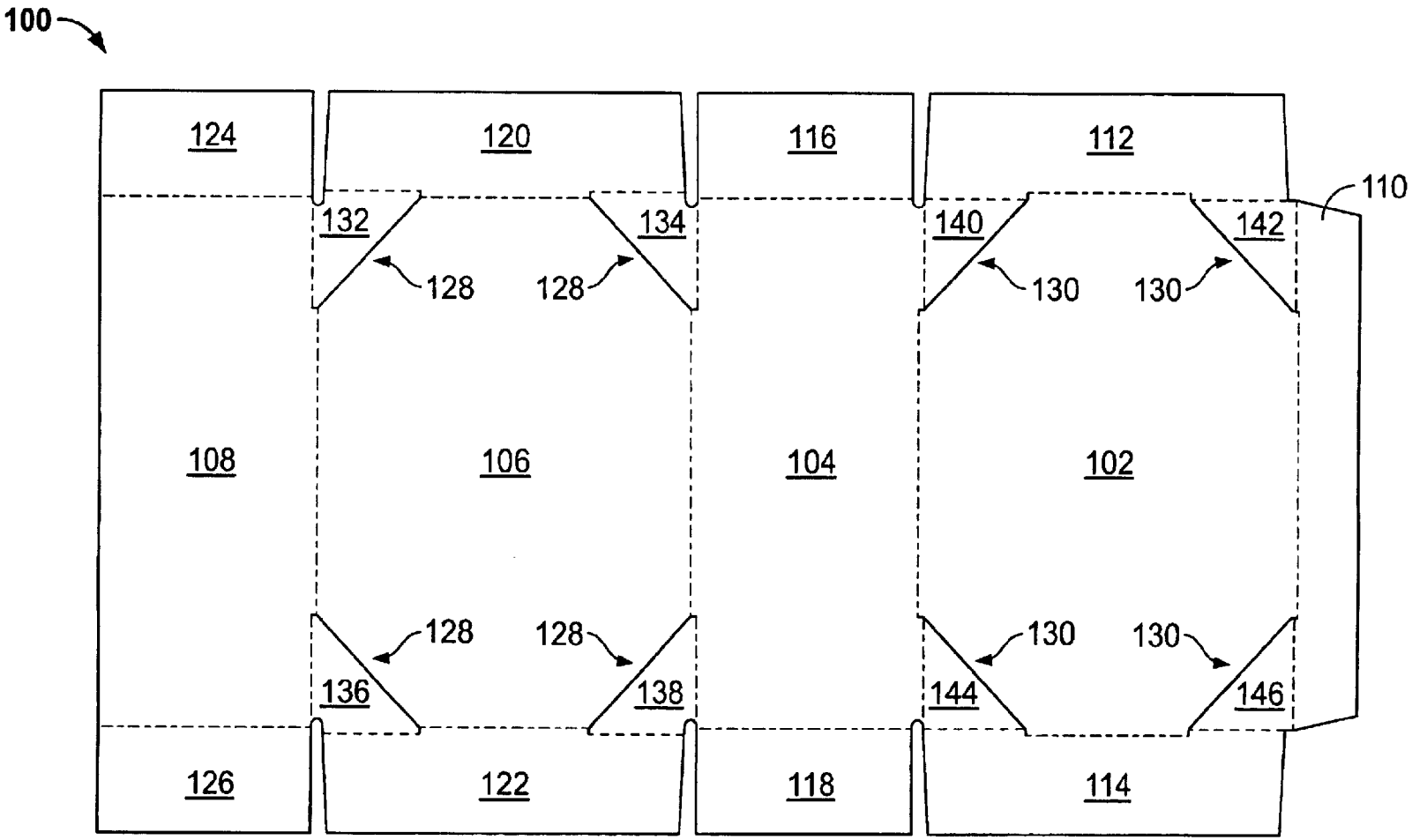
FIG. 5 illustrates a side overlapping seam wrap blank, in which the top and bottom panels are whole.

FIG. 5 illustrates a side overlapping seam wrap blank, in which the top and bottom panels are whole. The articulation of the blank, apart from the formation and operation of the interlock regions, may be the same as for such wrap blanks as may be known in the art.

Blank 100 includes bottom panel 102; back panel 104; top panel 106; front panel 108; closure flap 110; and flaps 112, 114, 116, 118, 120, 122, 124, 126. Blank 100 also includes "recess" interlock regions 128, and "projection" interlock regions 130, each having suitable diagonal and orthogonal cuts, and "angled " score lines, as described in detail with respect to FIG. 3. Upon articulation of blank 100, triangular sections 132, 134, 136 and 138 move out of plane, toward the observer of FIG. 5, while triangular sections 140, 142, 144, 146 move out of plane, away from the observer of FIG. 5.

Figure 6:
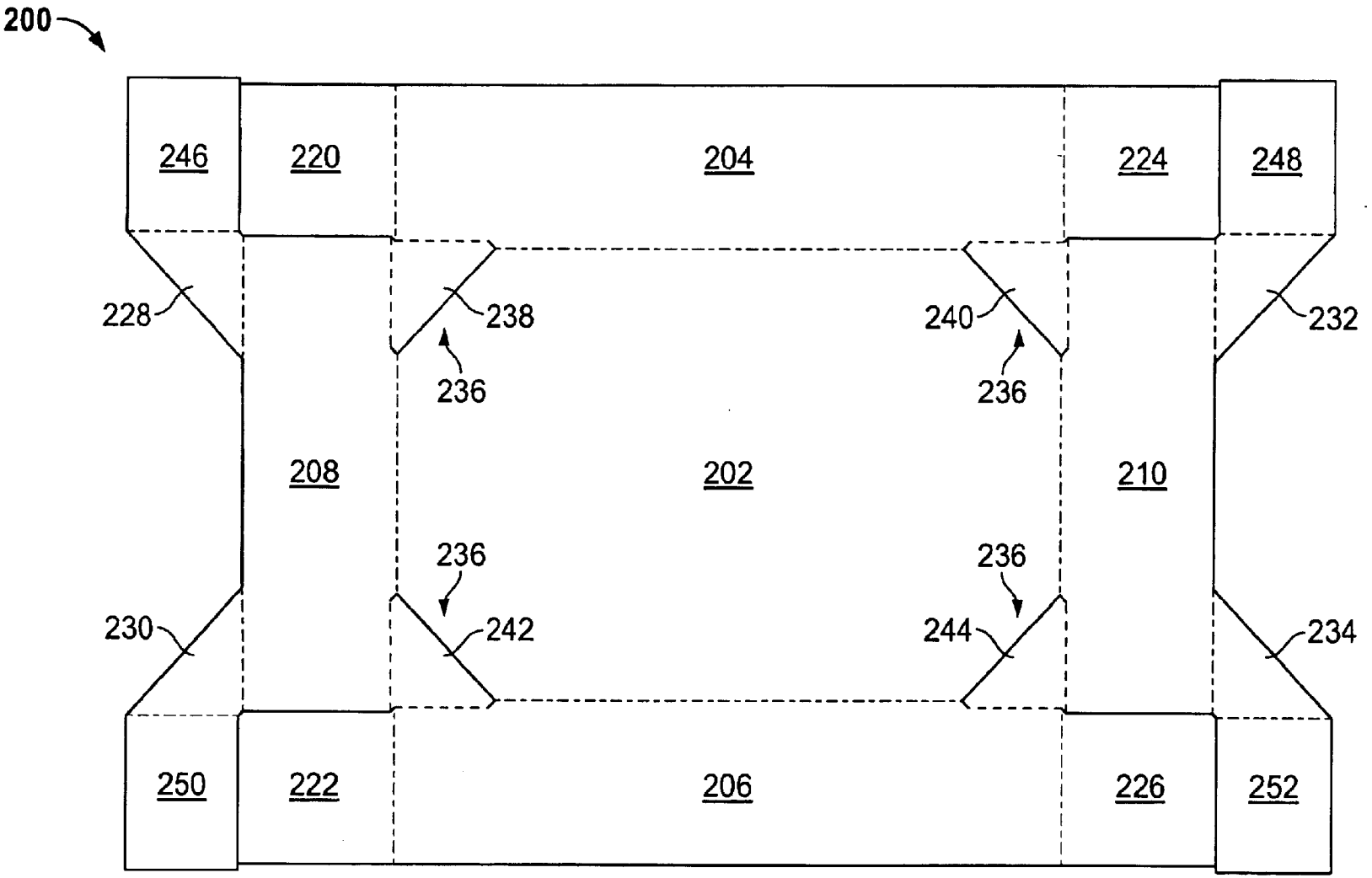
FIG. 6 illustrates a blank for an open-topped double-corner glued tray, in which the triangular interlock panels for the bottom are configured to be elevated with respect to the bottom panel, and the triangular interlock panels at the corners of the top of the tray, are configured to be received by the recesses formed in the bottom of a like tray set atop the first.

FIG. 6 illustrates a blank for an open-topped double-corner glued tray, in which the triangular interlock panels for the bottom are configured to be elevated with respect to the bottom panel, to form recesses, and the triangular interlock panels at the corners of the top of the tray, are configured to be received by the recesses formed in the bottom of a like tray set atop the first.

Blank 200 includes bottom panel 202; side panels 204, 206; end panels 208, 210; flaps 220, 222, 224, 226; top triangular panels 228, 230, 232, 234; "recess" interlock sections 236; triangular sections 238, 240, 242, 244; and top triangular sections 246, 248, 250, 252. The recess interlock sections 236 are formed in a manner as described hereinabove, employing "an gled" score lines, which extend into the adjacent side or end panel. However, "projection" type interlock regions are not provided. Rather, because the tray, formed by blank 200, does not include any top panels, only top triangular sections 228, 230, 232 and 234 are required. As there is no other material in the same "plane" as sections 228, 230, 232 and 234, those sections will fit neatly into corresponding recess interlock regions 236 of a like tray stacked atop the first.

The articulation of the blank, apart from the formation and operation of the interlock regions, may be the same as for such double corner glued tray blanks as may be known in the art. In general, however, it is understood that upon articulation of blank 200, flaps 220, 222, 224, 226 are folded to the inside of end panels 208, 210, while flaps 246, 248, 250 and 252 are folded to the outside of side panels 204, 206.

Figure 7:
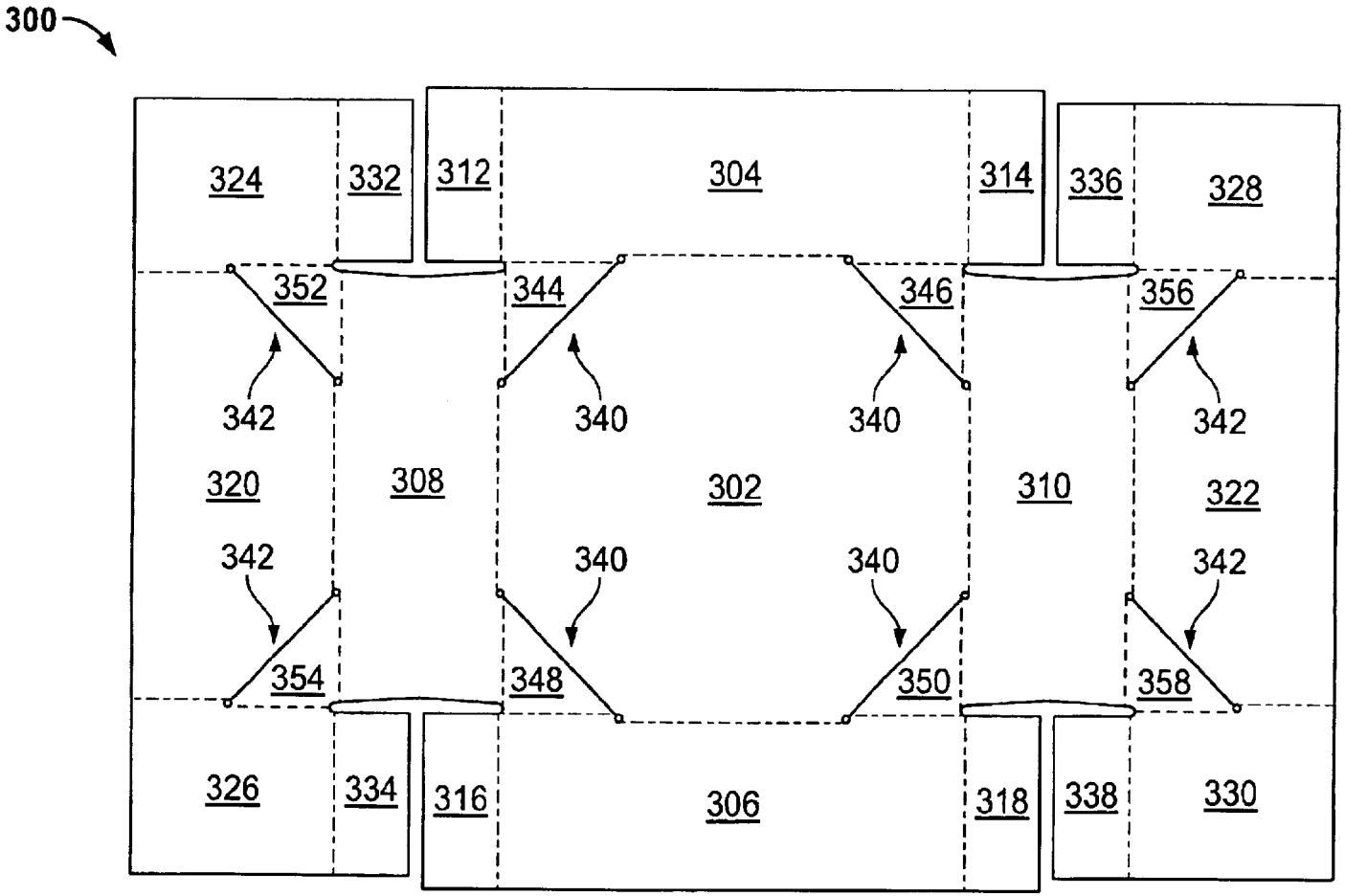
FIG. 7 illustrates a blank for a closed-top double corner glued tray, in which the orthogonal portions of the cuts forming the passive interlock feature are replaced by small diameter circular cut-outs. In addition, the interlock portions are reversed, as compared to the blank of FIG. 6, in that the "recesses" are in the top of the container, and the projecting triangular portions appear to be in the bottom of the container.

FIG. 7 illustrates a blank for a closed-top double corner glued tray, in which the orthogonal cuts, at the ends of the diagonal the cuts forming the interlock regions are replaced by small diameter circular cut-outs, which in some applications, may be desirable, for controlling of localized tearing during the articulation process. In addition, the interlock portions are reversed, as compared to the blank of FIG. 6, in that the "recess" interlock regions are in the top of the container, and the projecting triangular portions appear to be in the bottom of the container.

Blank 300 includes bottom panel 302; side panels 304, 306; end panels 308, 310; side panel flaps 312, 314, 316, 318; top panels 320, 322; top panel primary flaps 324, 326, 328, 330; top panel secondary flaps 332, 334, 336, 338; "projection" interlock regions 340; "recess" interlock regions 342; triangular sections 344, 346, 348, 350 (being pushed down—away from the viewer—upon articulation of the blank); and triangular sections 352, 354, 356, 358 (being pulled up—toward the viewer—upon articulation of the blank). The articulation of the blank, apart from the formation and operation of the interlock regions, may be the same as for such enclosed double corner glued tray blanks as may be known in the art. That is, flaps 312, 314, 316, 318 are folded to the inside of end panels 308, 310; top panel primary flaps 324, 326, 328 and 330 are folded to the outside of side panels 304, 306; and top panel secondary flaps 332, 334, 336 and 338 are folded to the outside of end panels 308, 310.

Figure 8:
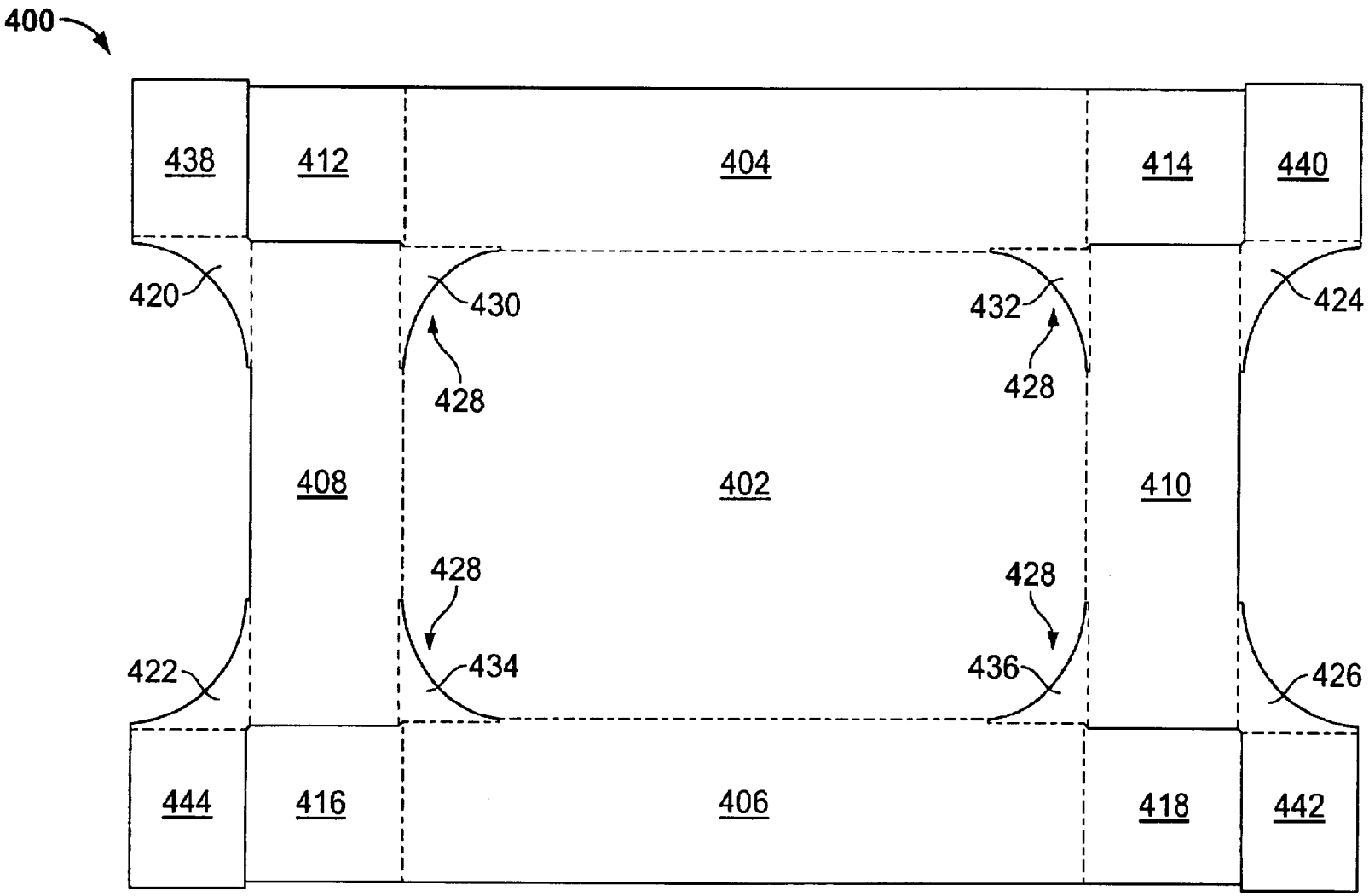
FIG. 8 illustrates a blank for an open-topped double corner glued tray, similar to that of FIG. 6, except that the panels forming the "recess" and "projection" interlock regions employ arcuate cuts instead of substantially straight diagonal cuts.

FIG. 8 illustrates a blank for an open-topped double corner glued tray, which is configured substantially similarly to the tray of FIG. 6, except that the straight diagonal cuts forming the free edges of the triangular sections of the "recess" interlock regions and the triangular top panels are replaced by panels with arcuate free edges. Specifically, blank 400 includes bottom panel 402; side panels 404, 406; end panels 408, 410; flaps 412, 414, 416, 418; top corner panels 420, 422, 424, 426; "recess" interlock regions 428, including corner sections 430, 432, 434, 436; and reinforcement panels 438, 440, 444, 442. Upon articulation, panels 412, 414, 416 and 418 are folded to the inside of end panels 408, 410, while reinforcement panels 438, 440, 442 and 444 are folded to the outside of side panels 404, 406. Upon articulation, panels 430, 432, 434, 436 are pulled up, out of plane, and toward the observer of FIG. 8. The top panels 420, 422, 424, 426 are not provided with angled score lines or are otherwise caused to be moved or displaced out of plane relative to any other adjacent panels. Rather, like the embodiment of FIG. 6, panels 420, 422, 424, 426 extend above the top edges of side panels 404, 406 and end panels 408, 410, and are received within the recesses formed by regions 428 of a similar tray, placed atop a first such tray.

Figure 9:
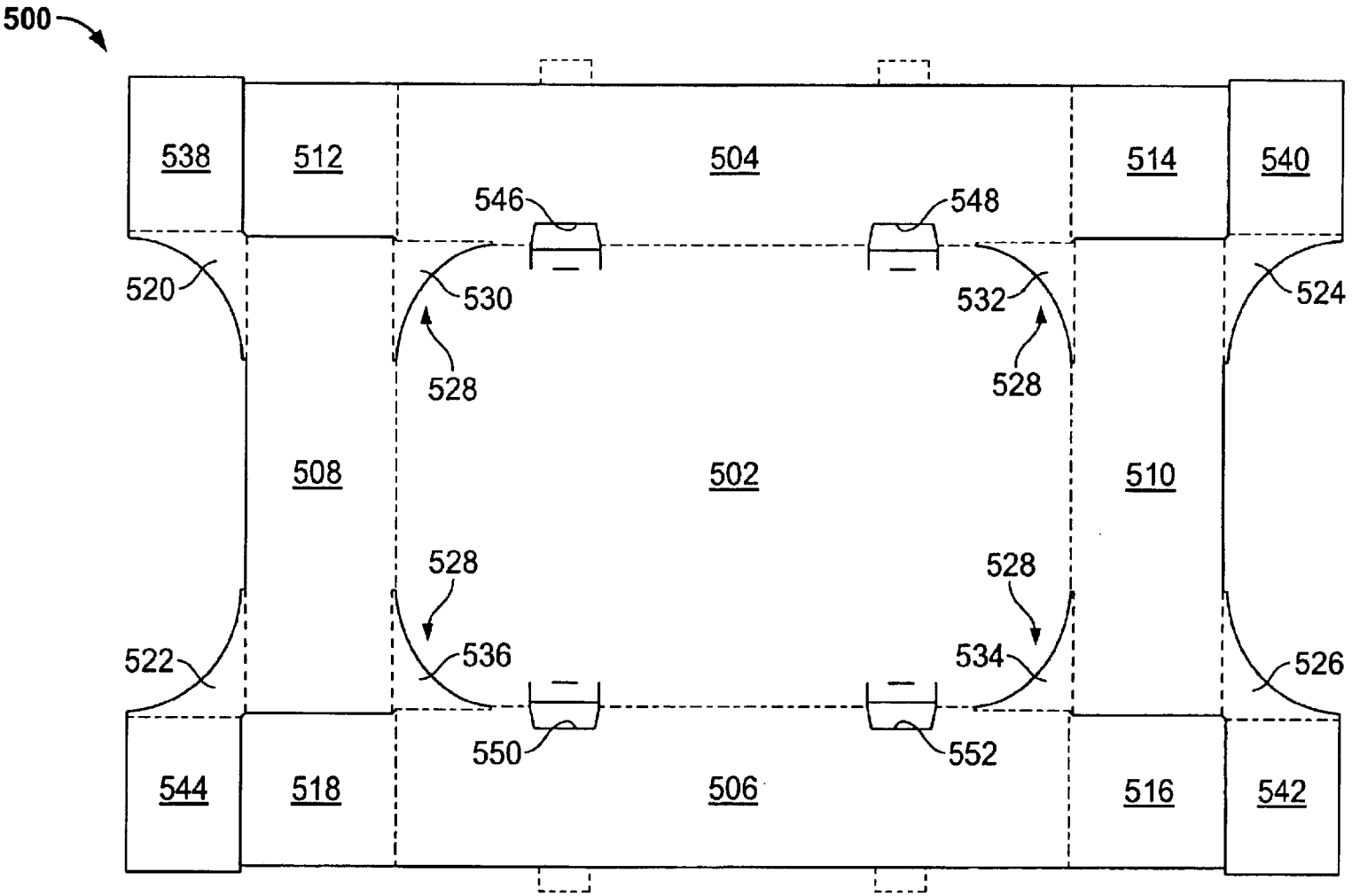
FIG. 9 illustrates a blank for an open-topped double corner glued tray, similar to that of FIG. 8, except that stacking tab receptacles are provided along the sides of the bottom panel.

FIG. 9 illustrates a blank for an open-topped double corner glued tray, similar to that of FIG. 8, except that stacking tab receptacles are provided along the sides of the bottom panel. Specifically, blank 500 includes bottom panel 502; side panels 504, 506; end panels 508, 510; flaps 512, 514, 516, 518; top corner panels 520, 522, 524, 526; "recess" interlock regions 528, including corner sections 530, 532, 534, 536; and reinforcement panels 538, 540, 544, 542. Upon articulation, panels 512, 514, 516 and 518 are folded to the inside of end panels 508, 510, while reinforcement panels 538, 540, 542 and 544 are folded to the outside of side panels 504, 506. Upon articulation, panels 530, 532, 534, 536 are pulled up, out of plane, and toward the observer of FIG. 9.

The top panels 520, 522, 524, 526 are not provided with angled score lines or are otherwise caused to be moved or displaced out of plane relative to any other adjacent panels. Rather, like the embodiment of FIG. 6, panels 520, 522, 524, 526 extend above the top edges of side panels 504, 506 and end panels 508, 510, and are received within the recesses formed by regions 528 of a similar tray, placed atop a first such tray. Stacking tab receptacles 546, 548, 550, 552, are provided in the form of diecut trapezoidal slots in blank 500. This will permit trays formed from blanks 500 to be used or stacked together with other, more traditional stacking tab-equipped trays. If desired, stacking tabs may be provided, as shown by the broken lines.

Figure 10:
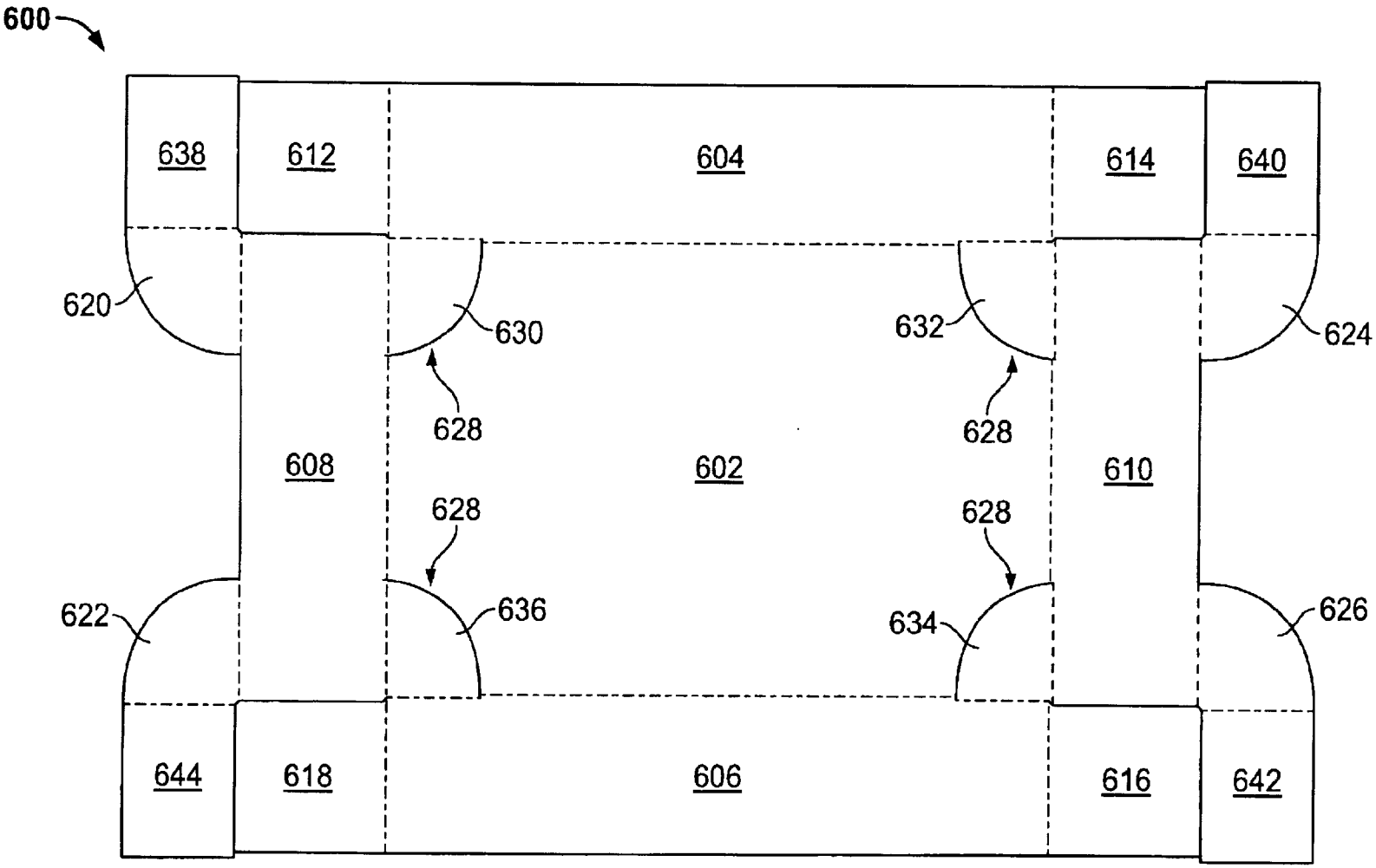
FIG. 10 illustrates a blank for an open-topped double corner glued tray, similar to that of FIG. 8, except that the arcuate cuts are convex, instead of concave.

FIG. 10 illustrates a blank for an open-topped double corner glued tray, similar to that of FIG. 8, except that the arcuate cuts are convex (toward the center of symmetry of the bottom panel), instead of concave. Specifically, blank 600 includes bottom panel 602; side panels 604, 606; end panels 608, 610; flaps 612, 614, 616, 618; top corner panels 620, 622, 624, 626; "recess" interlock regions 628, including corner sections 630, 632, 634, 636; and reinforcement panels 638, 640, 644, 642. Upon articulation, panels 612, 614, 616 and 618 are folded to the inside of end panels 608, 610, while reinforcement panels 638, 640, 642 and 644 are folded to the outside of side panels 604, 606. Upon articulation, panels 630, 632, 634, 636 are pulled up, out of plane, and toward the observer of FIG. 10.

The top panels 620, 622, 624, 626 are not provided with angled score lines or are otherwise caused to be moved or displaced out of plane relative to any other adjacent panels. Rather, like the embodiment of FIG. 6, panels 620, 622, 624, 626 extend above the top edges of side panels 604, 606 and end panels 608, 610, and are received within the recesses formed by regions 628 of a similar tray, placed atop a first such tray.

Figure 11:
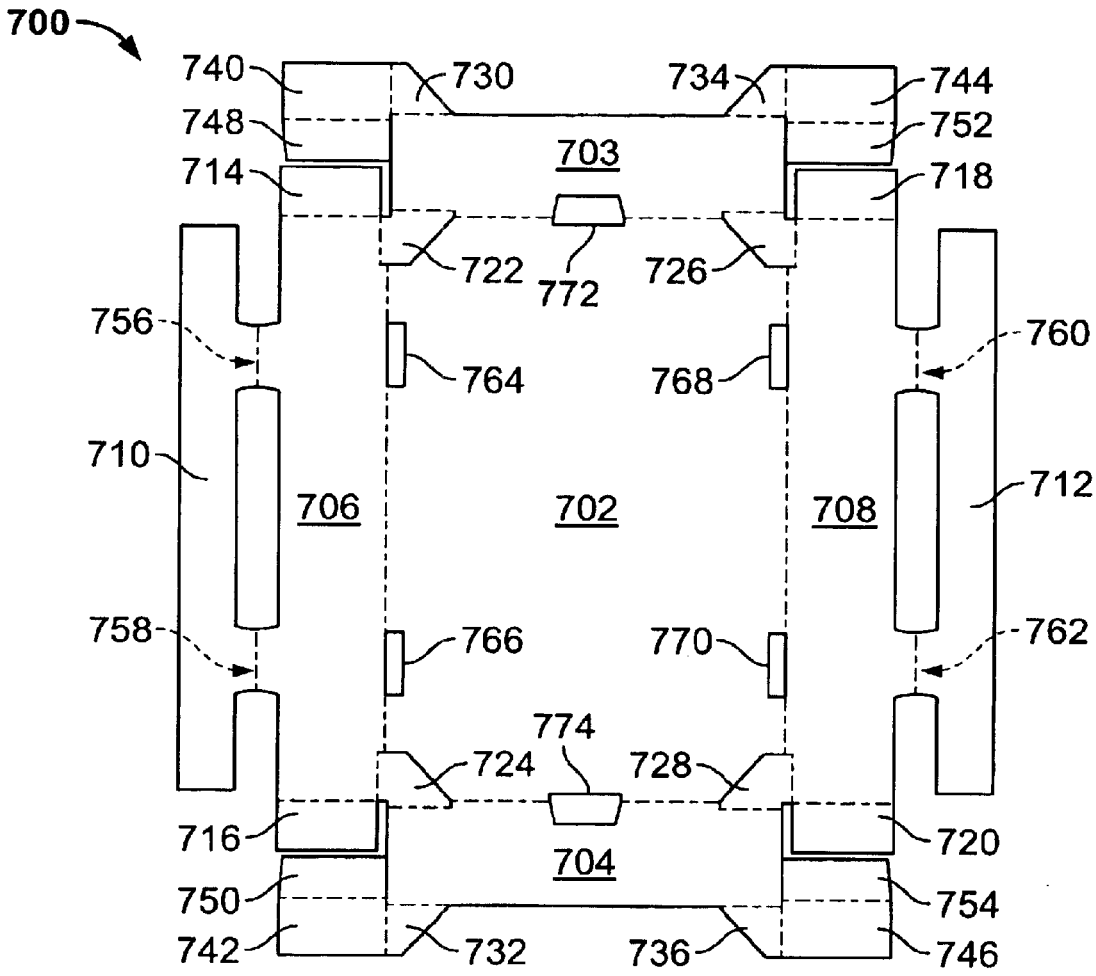
FIG. 11 illustrates a blank for an open-topped, double-corner glued tray, having diagonal corner cuts for forming the recesses, for receiving the corner top panels of a like tray.

FIG. 11 illustrates a blank for an open-topped, triple-corner glued tray, having diagonal corner cuts for forming the recesses, for receiving the corner top panels of a like tray. Blank 700 includes bottom panel 702; end panels 703, 704; side panels 706, 708; side reinforcement panels 710 and 712 which are folded over at webs 756, 758, 760 and 762, respectively, and glued to the inside surfaces of panels 710 and 712 (to form stacking tabs received in apertures 764, 766, 768, 770 of a like tray); inside reinforcement flanges 714, 716, 718, 720, that are folded to the inside of and affixed to the inside surfaces of end panels 703, 704; top corner panels 730, 732, 734 and 736, emanating from the top edges of end panels 703, 704; first outer reinforcement panels 740, 742, 744, 746 (which upon articulation are juxtaposed and affixed to the outside of the ends of side panels 706, 708) emanating from top corner panels 730, 732, 734 and 736; and second outer reinforcement panels 748, 750, 752 and 754 (which upon articulation are juxtaposed and affixed to the outside of end panels 703, 704), emanating from first outer reinforcement panels 740, 742, 744, 746. Bottom panel 702 includes recess forming corner panels 722, 724, 726, 728, formed by suitable angled score lines and bent diagonal die cuts, as described with respect to the previously discussed embodiments. Blank 700 may also include ventilation apertures 772, 774.

The top panels 730, 732, 734, 736 are not provided with angled score lines or are otherwise caused to be moved or displaced out of plane relative to any other adjacent panels.

Rather, like the embodiment of FIG. 6, panels 730, 732, 734, 736 extend above the top edges of side panels 706, 708, and end panels 703, 704, and are received within the recesses formed by corner panels 722, 724, 726, 728 of a similar tray, placed atop a first such tray.

Figure 12:
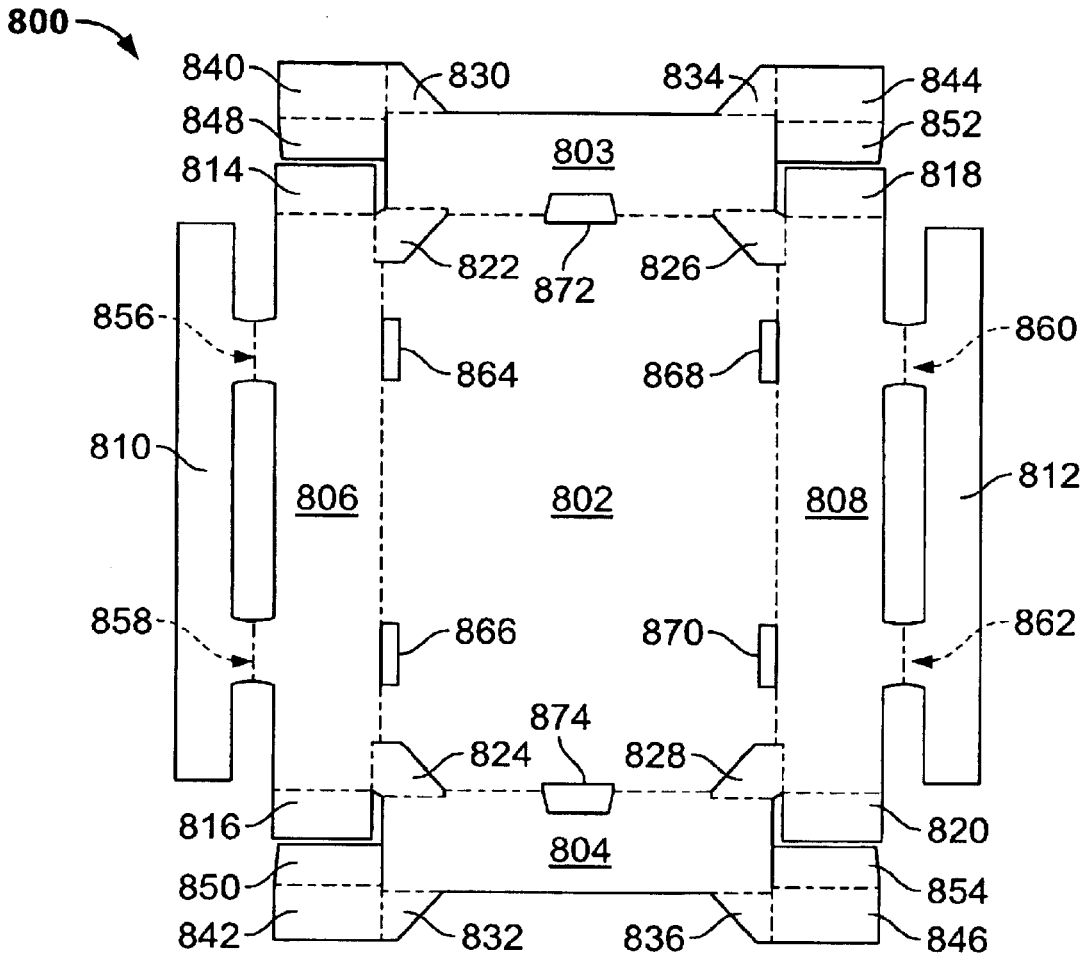
FIG. 12 illustrates a blank for an open-topped, double-corner glued tray, having diagonal corner cuts for forming the recesses, for receiving the corner top panels of a like tray, similar to the tray of FIG. 11, but having different proportions.

FIG. 12 illustrates a blank for an open-topped, triple-corner glued tray, having diagonal corner cuts for forming the recesses, for receiving the corner top panels of a like tray, similar to the tray of FIG. 11, but having different proportions.

FIG. 12 illustrates a blank for an open-topped, triple-corner glued tray, having diagonal corner cuts for forming the recesses, for receiving the corner top panels of a like tray. Blank 800 includes bottom panel 802; end panels 803, 804; side panels 806, 808; side reinforcement panels 810 and 812 which are folded over at webs 856, 858, 860 and 862, respectively, and glued to the inside surfaces of panels 810 and 812 (to form stacking tabs received in apertures 864, 866, 868, 870 of a like tray); inside reinforcement flanges 814, 816, 818, 820, that are folded to the inside of and affixed to the inside surfaces of end panels 803, 804; top corner panels 830, 832, 834 and 836, emanating from the top edges of end panels 803, 804; first outer reinforcement panels 840, 842, 844, 846 (which upon articulation are juxtaposed and affixed to the outside of the ends of side panels 806, 808) emanating from top corner panels 830, 832, 834 and 836; and second outer reinforcement panels 848, 850, 852 and 854 (which upon articulation are juxtaposed and affixed to the outside of end panels 803, 804), emanating from first outer reinforcement panels 840, 842, 844, 846. Bottom panel 802 includes recess forming corner panels 822, 824, 826, 828, formed by suitable angled score lines and bent diagonal die cuts, as described with respect to the previously discussed embodiments. Blank 800 may also include ventilation apertures 872, 874.

The top panels 830, 832, 834, 836 are not provided with angled score lines or are otherwise caused to be moved or displaced out of plane relative to any other adjacent panels. Rather, like the embodiment of FIG. 6, panels 830, 832, 834, 836 extend above the top edges of side panels 806, 808, and end panels 803, 804, and are received within the recesses formed by corner panels 822, 824, 826, 828 of a similar tray, placed atop a first such tray.

Figure 13:
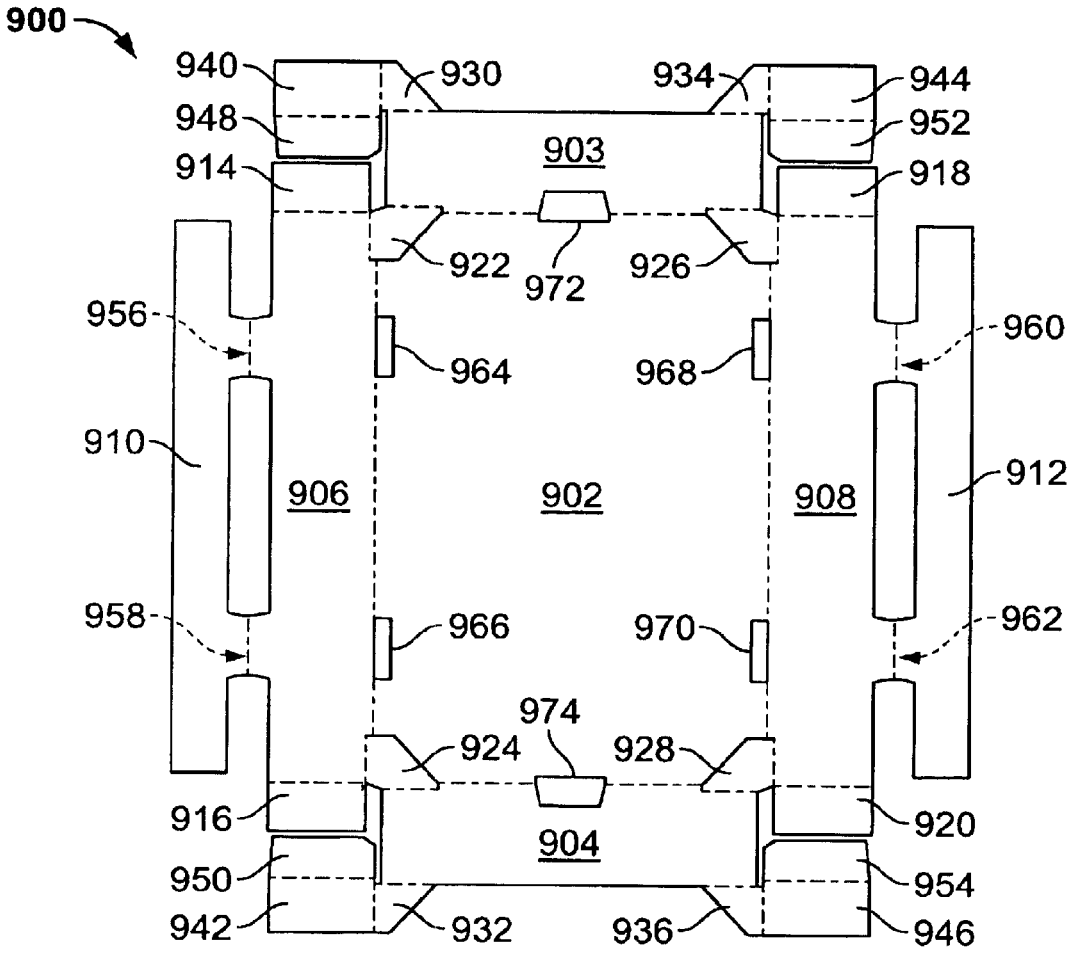
FIG. 13 illustrates a blank for an open-topped, double-corner glued tray, having diagonal corner cuts for forming the recesses, for receiving the corner top panels of a like tray, similar to the tray of FIG. 11, but having different proportions.

FIG. 13 illustrates a blank for an open-topped, triple-corner glued tray, having diagonal corner cuts for forming the recesses, for receiving the corner top panels of a like tray, similar to the tray of FIG. 11, but having different proportions.

FIG. 13 illustrates a blank for an open-topped, triple-corner glued tray, having diagonal corner cuts for forming the recesses, for receiving the corner top panels of a like tray. Blank 900 includes bottom panel 902; end panels 903, 904; side panels 906, 908; side reinforcement panels 910 and 912 which are folded over at webs 956, 958, 960 and 962, respectively, and glued to the inside surfaces of panels 910 and 912 (to form stacking tabs received in apertures 964, 966, 968, 970 of a like tray); inside reinforcement flanges 914, 916, 918, 920, that are folded to the inside of and affixed to the inside surfaces of end panels 903, 904; top corner panels 930, 932, 934 and 936, emanating from the top edges of end panels 903, 904; first outer reinforcement panels 940, 942, 944, 946 (which upon articulation are juxtaposed and affixed to the outside of the ends of side panels 906, 908) emanating from top corner panels 930, 932, 934 and 936; and second outer reinforcement panels 948, 950, 952 and 954 (which upon articulation are juxtaposed and affixed to the outside of end panels 903, 904), emanating from first outer reinforcement panels 940, 942, 944, 946. Bottom panel 902 includes recess forming corner panels 922, 924, 926, 928, formed by suitable angled score lines and bent diagonal die cuts, as described with respect to the previously discussed embodiments. Blank 900 may also include ventilation apertures 972, 974.

The top panels 930, 932, 934, 936 are not provided with angled score lines or are otherwise caused to be moved or displaced out of plane relative to any other adjacent panels. Rather, like the embodiment of FIG. 6, panels 930, 932, 934, 936 extend above the top edges of side panels 906, 908, and end panels 903, 904, and are received within the recesses formed by corner panels 922, 924, 926, 928 of a similar tray, placed atop a first such tray.

Figure 14:
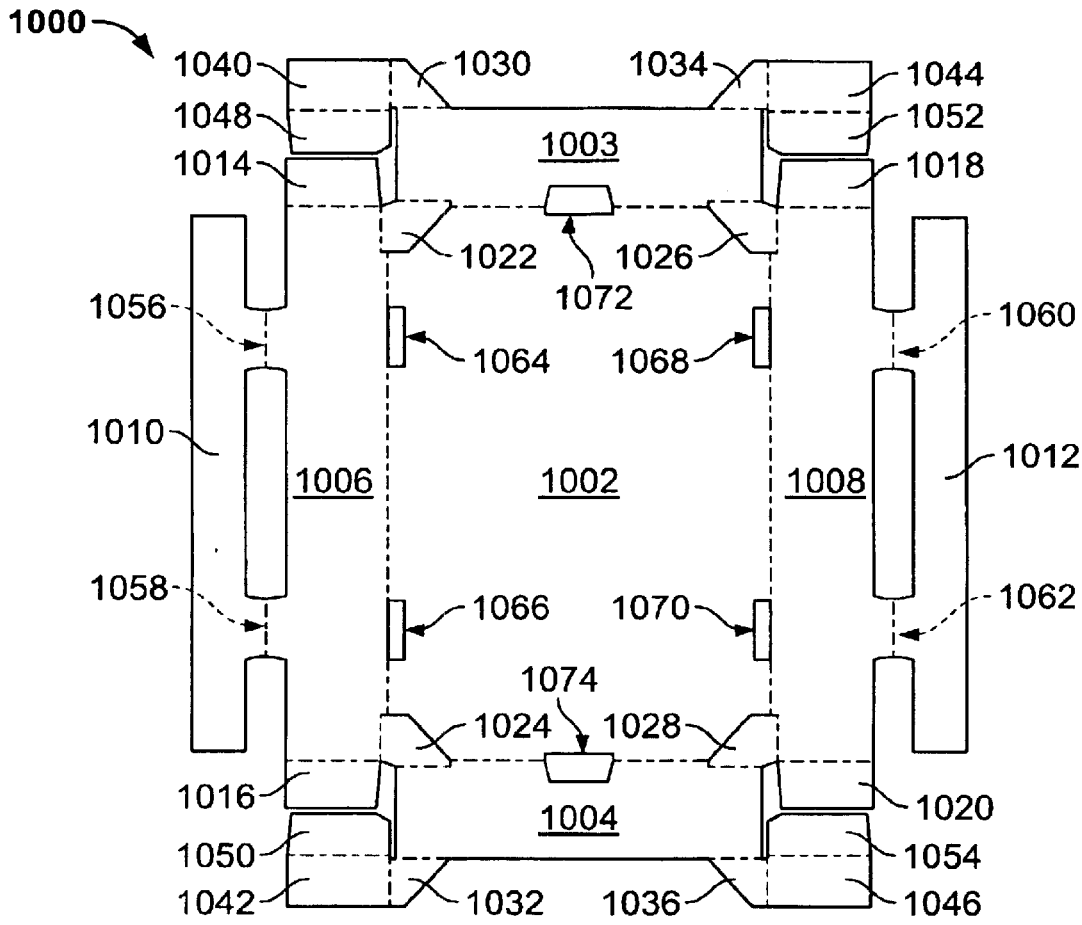
FIG. 14 illustrates a blank for an open-topped, double-corner glued tray, having diagonal corner cuts for forming the recesses, for receiving the corner top panels of a like tray, similar to the tray of FIG. 13, but with panels shaped to provide for inclined side walls when the tray is fully articulated.

FIG. 14 illustrates a blank for an open-topped, triple-corner glued tray, having diagonal corner cuts for forming the recesses, for receiving the corner top panels of a like tray, similar to the tray of FIG. 13, but with panels shaped to provide for inclined side walls when the tray is fully articulated.

FIG. 14 illustrates a blank for an open-topped, triple-corner glued tray, having diagonal corner cuts for forming the recesses, for receiving the corner top panels of a like tray. Blank 1000 includes bottom panel 1002; end panels 1003, 1004; side panels 1006, 1008; side reinforcement panels 1010 and 1012 which are folded over at webs 1056, 1058, 1060 and 1062, respectively, and glued to the inside surfaces of panels 1010 and 1012 (to form stacking tabs received in apertures 1064, 1066, 1068, 1070 of a like tray); inside reinforcement flanges 1014, 1016, 1018, 1020, that are folded to the inside of and affixed to the inside surfaces of end panels 1003, 1004; top corner panels 1030, 1032, 1034 and 1036, emanating from the top edges of end panels 1003, 1004; first outer reinforcement panels 1040, 1042, 1044, 1046 (which upon articulation are juxtaposed and affixed to the outside of the ends of side panels 1006, 1008) emanating from top corner panels 1030, 1032, 1034 and 1036; and second outer reinforcement panels 1048, 1050, 1052 and 1054 (which upon articulation are juxtaposed and affixed to the outside of end panels 1003, 1004), emanating from first outer reinforcement panels 1040, 1042, 1044, 1046. Bottom panel 1002 includes recess forming corner panels 1022, 1024, 1026, 1028, formed by suitable angled score lines and bent diagonal die cuts, as described with respect to the previously discussed embodiments. Blank 1000 may also include ventilation apertures 1072, 1074.

The top panels 1030, 1032, 1034, 1036 are not provided with angled score lines or are otherwise caused to be moved or displaced out of plane relative to any other adjacent panels. Rather, like the embodiment of FIG. 6, panels 1030, 1032, 1034, 1036 extend above the top edges of side panels 1006, 1008, and end panels 1003, 1004, and are received within the recesses formed by corner panels 1022, 1024, 1026, 1028 of a similar tray, placed atop a first such tray.

Figure 15:
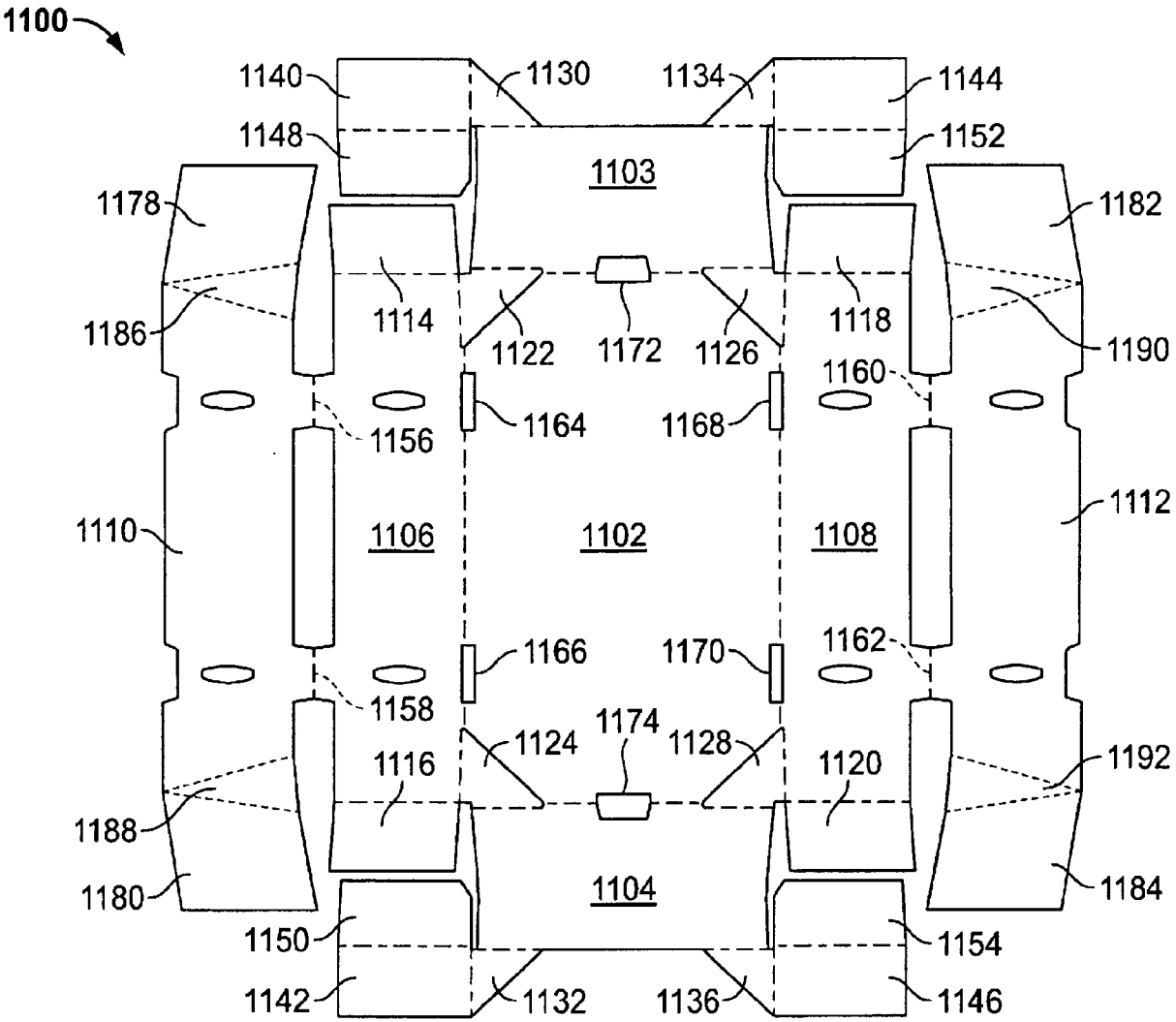
FIG. 15 illustrates a blank for an open-topped, triple-corner glued tray, having diagonal corner cuts for forming the recesses, for receiving the corner top panels of a like tray, similar to the tray of FIG. 14, but with panels shaped to provide for inclined side walls when the tray is fully articulated, and with interior V-shaped corner gussets.

FIG. 15 illustrates a blank for an open-topped, triple-corner glued tray, having diagonal corner cuts for forming the recesses, for receiving the corner top panels of a like tray, similar to the tray of FIG. 14, but with panels shaped to provide for inclined side walls when the tray is fully articulated, and with interior V-shaped corner gussets.

FIG. 15 illustrates a blank for an open-topped, triple-corner glued tray, having diagonal corner cuts for forming the recesses, for receiving the corner top panels of a like tray. Blank 1100 includes bottom panel 1102; end panels 1103, 1104; side panels 1106, 1108; side reinforcement panels 1110 and 1112 which are folded over at webs 1156, 1158, 1160 and 1162, respectively, and glued to the inside surfaces of panels 1110 and 1112 (to form stacking tabs received in apertures 1164, 1166, 1168, 1170 of a like tray); inside reinforcement flanges 1114, 1116, 1118, 1120, that are folded to the inside of and affixed to the inside surfaces of end panels 1103, 1104; top corner panels 1130, 1132, 1134 and 1136, emanating from the top edges of end panels 1103, 1104; first outer reinforcement panels 1140, 1142, 1144, 1146 (which upon articulation are juxtaposed and affixed to the outside of the ends of side panels 1106, 1108) emanating from top corner panels 1130, 1132, 1134 and 1136; and second outer reinforcement panels 1148, 1150, 1152 and 1154 (which upon articulation are juxtaposed and affixed to the outside of end panels 1103, 1104), emanating from first outer reinforcement panels 1140, 1142, 1144, 1146. Bottom panel 1102 includes recess forming corner panels 1122, 1124, 1126, 1128, formed by suitable angled score lines and bent diagonal die cuts, as described with respect to the previously discussed embodiments. Blank 1100 may also include ventilation apertures 1172, 1174.

Blank 1100 also includes interior reinforcing flanges 1178, 1180, 1182, 1184, and V-shaped corner gussets 1186, 1188, 1190, 1192. When panels 1110 and 1112 are folded inward and affixed to the inside surfaces of 1106, 1108, respectively, flanges 1178, 1180, 1182, 1184 are juxtaposed against the inside surfaces of panels 1103, 1104, and gussets 1186, 1188, 1190, 1192 are positioned over the corner regions of bottom panel 1102, with the narrow ends of gussets 1186, 1188, 1190, 1192, pointing downward and outwardly, so that gussets 1186, 1188, 1190, 1192 are inclined toward the interior of the articulated container, and the broad ends of gussets 1186, 1188, 1190, 1192 extend diagonally across the respective corners of the resultant tray.

The top panels 1130, 1132, 1134, 1136 are not provided with angled score lines or are otherwise caused to be moved or displaced out of plane relative to any other adjacent panels. Rather, like the embodiment of FIG. 6, panels 1130, 1132, 1134, 1136 extend above the top edges of side panels 1106, 1108, and end panels 1103, 1104, and are received within the recesses formed by corner panels 1122, 1124, 1126, 1128 of a similar tray, placed atop a first such tray.

Figure 16:
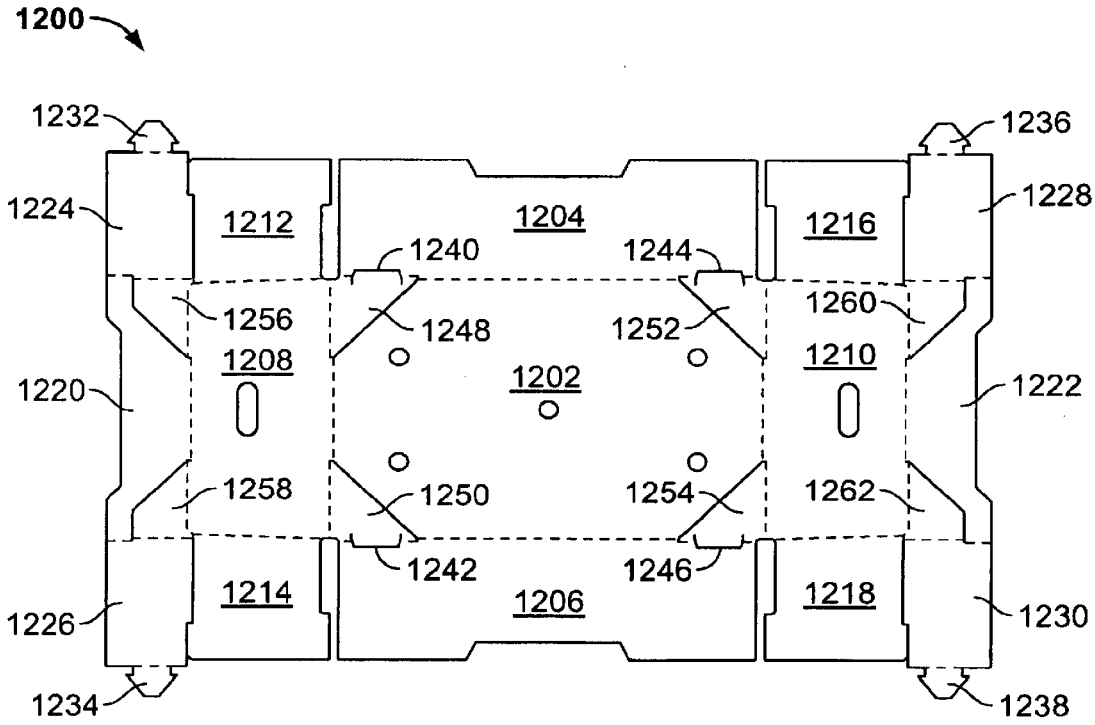
FIG. 16 illustrates a blank for an open-topped tray with reinforcing flaps and locking tabs, for a self-locking non-adhesive tray construction, incorporating the passive interlocking feature.

FIG. 16 illustrates a blank for an open-topped tray with reinforcing flaps and locking tabs, for a self-locking non-adhesive tray construction, incorporating the passive interlocking feature.

Blank 1200 includes bottom panel 1202; side panels 1204, 1206; end panels 1208, 1210; interior reinforcement flaps 1212, 1214, 1216, 1218 (which, upon articulation of the container, are positioned to the inside of raised side panels 1204, 1206); top panels 1220, 1222; closure flaps 1224, 1226, 1228, 1230 (which, once top panels have been folded inwardly to positions parallel to bottom panel 1202, are folded down to the outside of side panels 1204, 1206); and closure tabs 1232, 1234, 1236, 1238 (which, upon articulation of closure flaps 1224, 1226, 1228, 1230, are inserted into slots 1240, 1242, 1244, 1246, respectively, so that the resultant tray has a self-locking structure, not requiring adhesives). The side edge regions of end panels 1208 and 1210 are inclined so that upon articulation of the blank, the resultant container has inclined side panels.

Blank 1200 also includes movable corner panels 1248, 1250, 1252, 1254 which, upon articulation of side panels 1204, 1206, and end panels 1208, 1210, are raised relative to bottom panel 1202, to provide the recesses for the passive interlock feature. Top panels 1220, 1222 include movable corner panels 1256, 1258, 1260, 1262, which, upon articulation of top panels 1220, 1222, are raised with respect to top panels 1220, 1222, to form the projections that would be received in the recesses in the bottom of a like tray, during stacking of such trays.

Figure 17:
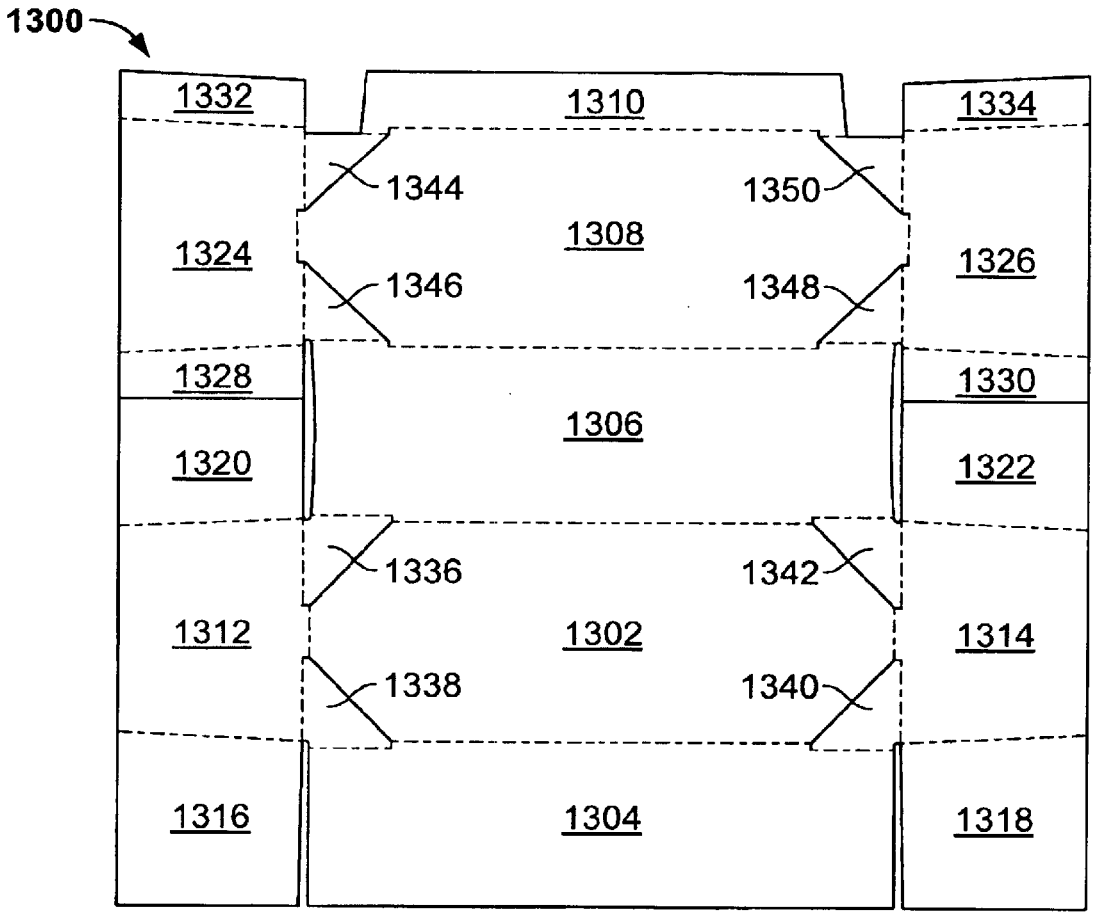
FIG. 17 illustrates a blank for a wraparound style container, having corner reinforcing flanges, and inclined side and end panels, incorporating the passive interlocking feature.

FIG. 17 illustrates a blank for a wraparound style container, having corner reinforcing flanges, and inclined side and end panels, incorporating the passive interlocking feature.

Blank 1300 includes bottom panel 1302; front panel 1304; rear panel 1306; top panel 1308; closure flap 1310; inside end panels 1312, 1314; inner support panels 1316, 1318, 1320, 1322 (which are juxtaposed against the inside surfaces of front panel 1304 and rear panel 1306, upon articulation of blank 1300); outside end panels 1324, 1326 (which overlie inside end panels 1312, 1314, when top panel 1308 is folded down parallel to bottom panel 1302); and outside reinforcement flanges 1328, 1330, 1332, 1334 (which overlie and are affixed to the outside surfaces of front panel 1304 and rear panel 1306, upon articulation of blank 1300).

Blank 1302 also includes movable bottom corner panels 1336, 1338, 1340, 1342, which, upon raising of front panel 1304, rear panel 1306, and inside end panels 1312, 1314, move upwardly relative to bottom panel 1302, to form the recesses of the passive interlock feature. Top corner panels 1344, 1346, 1348, 1350 are movable in that upon articulation of outside end panels 1324, 1326, those top corner panels move upwardly relative to top panel 1308, to form the projections that would be received in the recesses of a like tray that would be stacked atop a first such tray formed from blank 1302.

Figure 18:
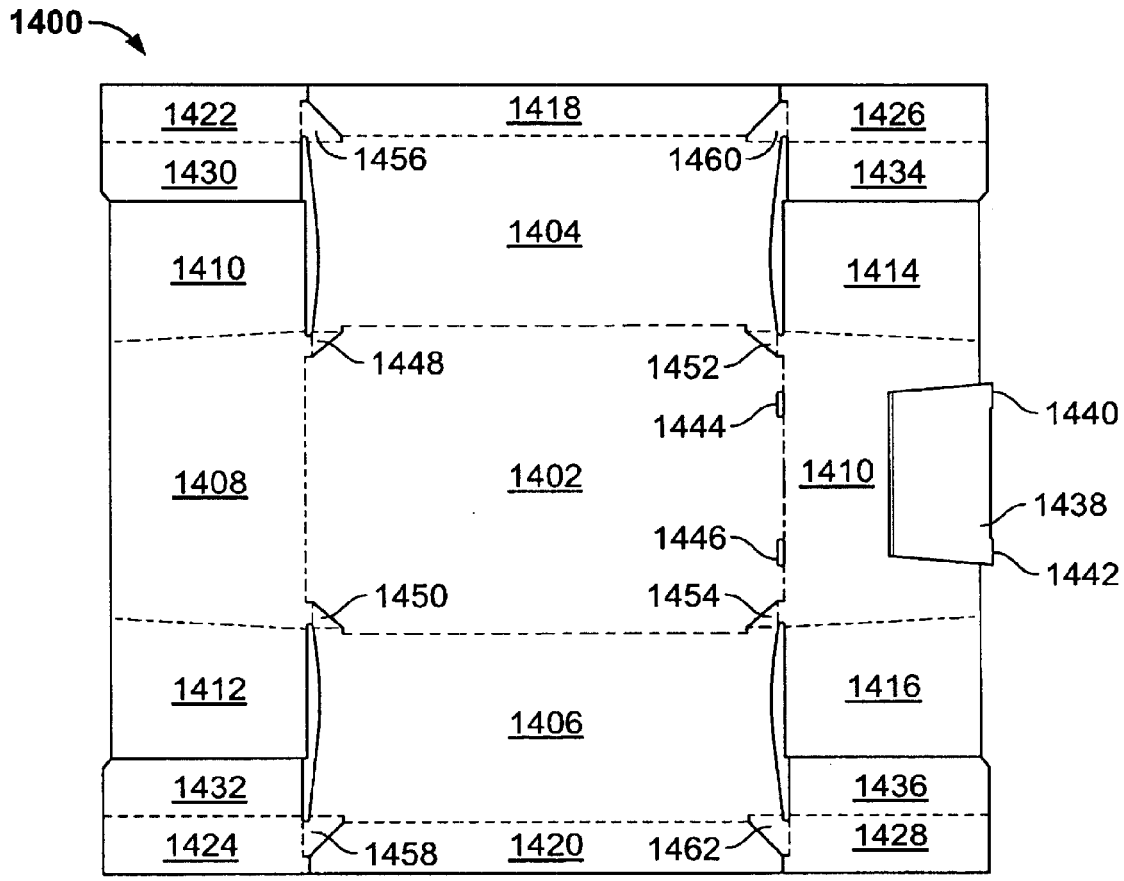
FIG. 18 illustrates a blank for a double-corner glued tray, incorporating the passive interlocking feature.

FIG. 18 illustrates a blank for a triple-corner glued tray, incorporating the passive interlocking feature, and having an end-opening for providing visibility, in the environment of placement of the trays, end-on, on display shelves, to act like drawers that may be pulled out by the consumer to access goods seen through the end-opening.

Blank 1400 includes bottom panel 1402; rear panel 1404; front panel 1406; end panels 1408, 1410; inside support panels 1410, 1412, 1414, 1416 (which upon articulation, are juxtaposed against the inside surfaces of side panels 1404, 1406); top panels 1418, 1420; first outside support flanges 1422, 1424, 1426, 1428 (which upon the folding of top panels 1418, 1420 to positions parallel to bottom panel 1402, are folded down to positions juxtaposed against the outside surfaces of end panels 1408, 1410); and second outside support flanges 1430, 1432, 1434, 1436 (which, upon the placement of first outside support flanges 1422, 1424, 1426, 1428, are folded against and affixed to the outside surfaces of side panels 1404, 1406).

Blank 1400 also includes bottom corner panels 1448, 1450, 1452, 1454, which are configured to rise, relative to bottom panel 1402, when side panels 1404, 1406 and end panels 1408, 1410 are folded relative to bottom panel 1402, to form the recesses of the passive interlock feature. Blank 1400 also includes top corner panels 1456, 1458, 1460, 1462, which, upon positioning of top panels 1418, 1420, and the folding down of first reinforcement flanges 1422, 1424, 1426, 1428, are pushed upwardly relative to top panels 1418, 1420, to form the projections configured to be received by the recesses of another like tray, during stacking.

Blank 1400 also includes a fold-down "handle" panel 1438, having two tab projections 1440, 1442, which, when panel 1438 is folded to the inside of panel 1410, are received in slots 1444, 1446. This creates an opening through which products may seen. By placing the tray on a shelf so that the long axis of the tray is perpendicular to the shelf edge, with the opening facing the customer, if the customer desires products from the tray, he or she can grab the tray long the bottom edge of the opening (which has been reinforced by the fold-over flap), and pull it toward him/her, like a drawer, to retrieve the desired goods.

Figure 19:
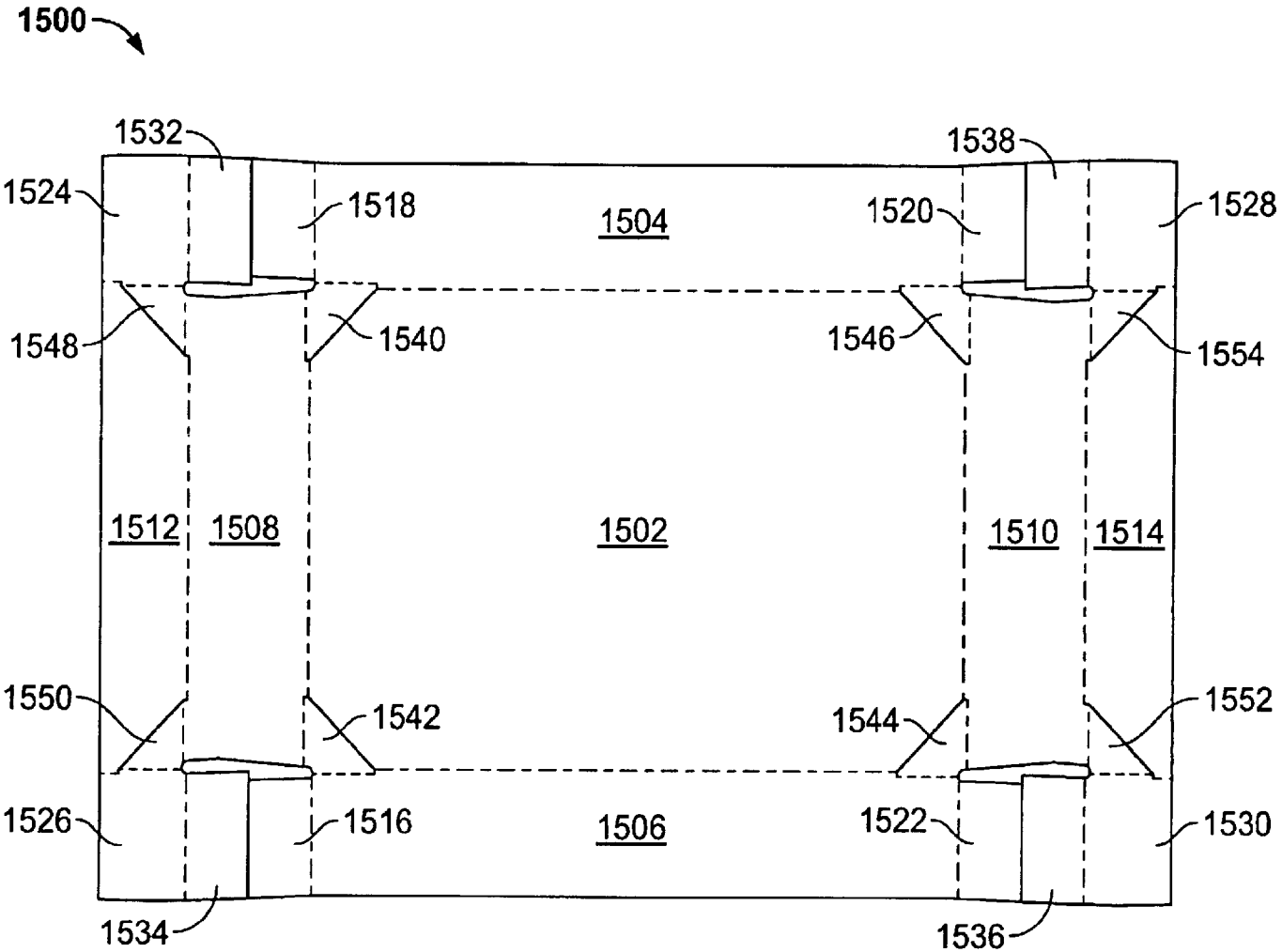
FIG. 19 illustrates a blank for a double-corner glued tray, with inclined side walls, incorporating the passive interlocking feature.

FIG. 19 illustrates a blank for a triple-corner glued tray, with inclined side walls, incorporating the passive interlocking feature.

Blank 1500 includes bottom panel 1502; side panels 1504, 1506; end panels 1508, 1510; top panels 1512, 1514; inside support flaps 1516, 1518, 1520, 1522 (which, upon articulation, are juxtaposed against the inside surfaces of the end panels 1508, 1510); first outside support flaps 1524,

1526, 1528, 1530 (which, upon articulation, are juxtaposed against the outside surfaces of side panels 1504, 1506); and second outside support flaps 1532, 1534, 1536, 1538 (which, upon articulation are juxtaposed against and affixed to outside surfaces of the end panels 1508, 1510).

Blank 1500, also includes movable bottom corner panels 1540, 1542, 1544, 1546, which, upon folding up of side panels 1504, 1506, and end panels 1508, 1510, are moved upward relative to bottom panel 1502, to form the recesses for the passive interlock feature. Movable top corner panels 1458, 1550, 1552, 1554, upon folding down of first outside reinforcement flaps 1524, 1526, 1528, 1530, are moved upward relative to top panels 1512, 1514, to form the projections that would be received by the recesses of a like tray during stacking.

The side panels and associated flaps are appropriately configured so that upon articulation, the side panels are inwardly inclined.

Figure 20:
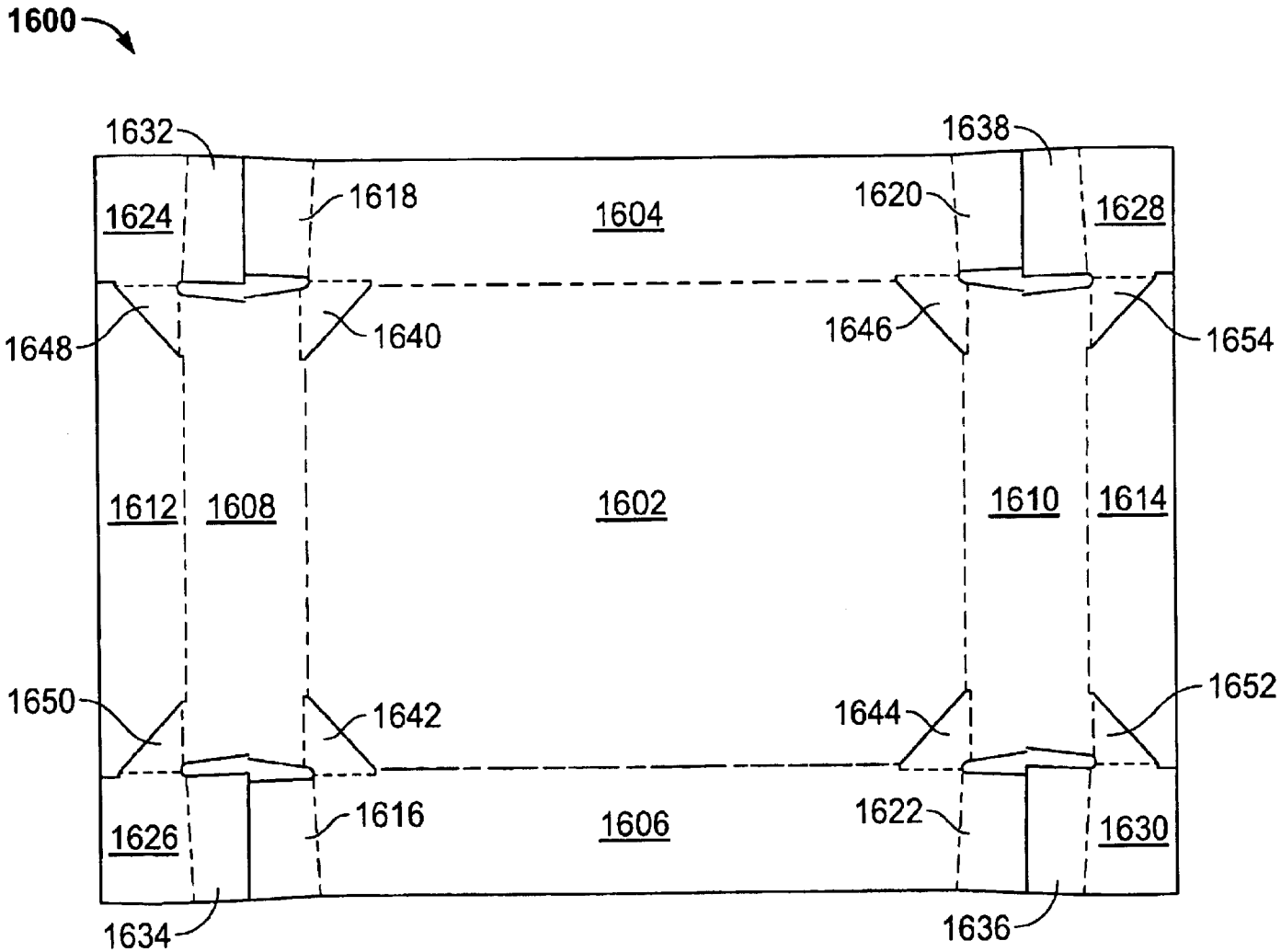
FIG. 20 illustrates a blank for a double-corner glued tray, with inclined side walls, incorporating the passive interlocking feature.

FIG. 20 illustrates a blank for a triple-corner glued tray, with inclined side walls, incorporating the passive interlocking feature.

Blank 1600 includes bottom panel 1602; side panels 1604, 1606; end panels 1608, 1610; top panels 1612, 1614; inside support flaps 1616, 1618, 1620, 1622 (which, upon articulation, are juxtaposed against the inside surfaces of the end panels 1608, 1610); first outside support flaps 1624, 1626, 1628, 1630 (which, upon articulation, are juxtaposed against the outside surfaces of side panels 1604, 1606); and second outside support flaps 1632, 1634, 1636, 1638 (which, upon articulation are juxtaposed against and affixed to outside surfaces of the end panels 1608, 1610).

Blank 1600, also includes movable bottom corner panels 1640, 1642, 1644, 1646, which, upon folding up of side panels 1604, 1606, and end panels 1608, 1610, are moved upward relative to bottom panel 1602, to form the recesses for the passive interlock feature. Movable top corner panels 1458, 1650, 1652, 1654, upon folding down of first outside reinforcement flaps 1624, 1626, 1628, 1630, are moved upward relative to top panels 1612, 1614, to form the projections that would be received by the recesses of a like tray during stacking.

The side panels and associated flaps are appropriately configured so that upon articulation, the side panels are inwardly inclined.

Figure 21:
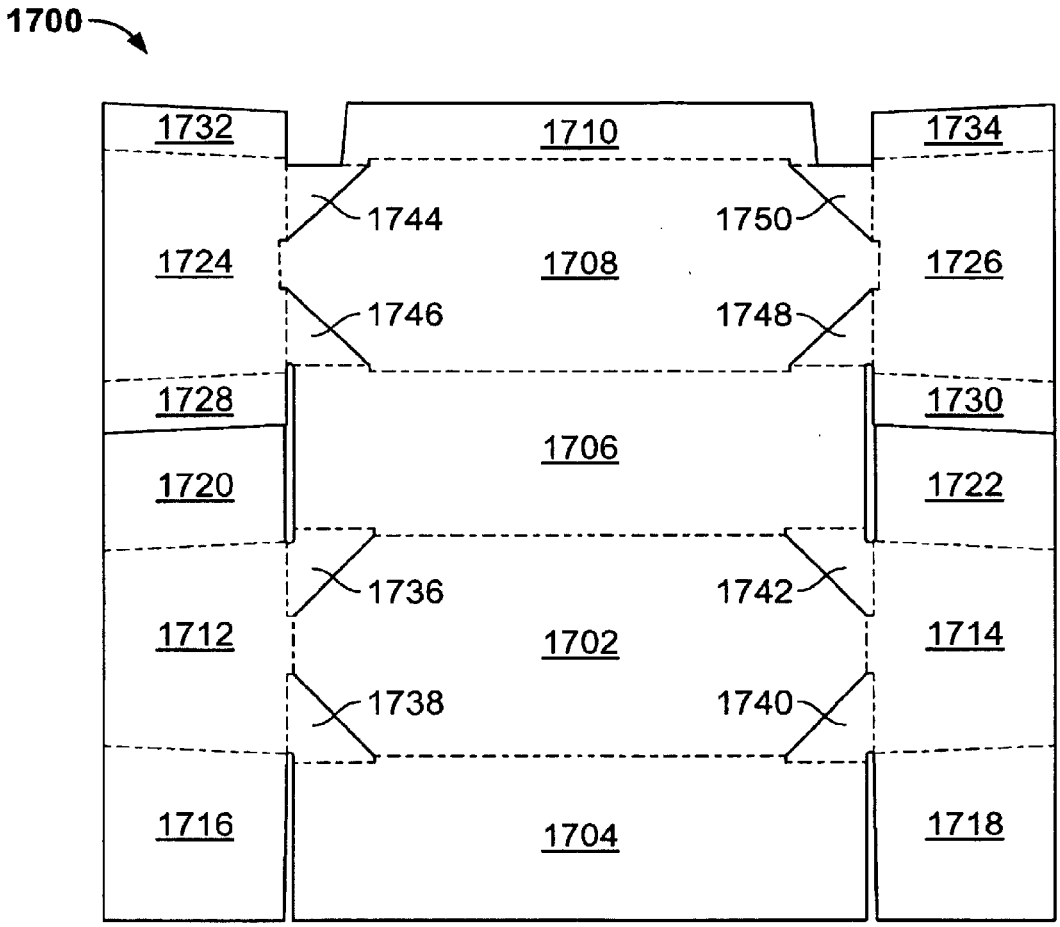
FIG. 21 illustrates a blank for a quad-corner wraparound style container, having corner reinforcing flanges, and inclined side and end panels, incorporating the passive interlocking feature.

FIG. 21 illustrates a blank for a wraparound style container, having corner reinforcing flanges, and inclined side and end panels, incorporating the passive interlocking feature.

Blank 1700 includes bottom panel 1702; front panel 1704; rear panel 1706; top panel 1708; closure flap 1710; inside end panels 1712, 1714; inner support panels 1716, 1718, 1720, 1722 (which are juxtaposed against the inside surfaces of front panel 1704 and rear panel 1706, upon articulation of blank 1700); outside end panels 1724, 1726 (which overlie inside end panels 1712, 1714, when top panel 1708 is folded down parallel to bottom panel 1702); and outside reinforcement flanges 1728, 1730, 1732, 1734 (which overlie and are affixed to the outside surfaces of front panel 1704 and rear panel 1706, upon articulation of blank 1700).

Blank 1702 also includes movable bottom corner panels 1736, 1738, 1740, 1742, which, upon raising of front panel 1704, rear panel 1706, and inside end panels 1712, 1714, move upwardly relative to bottom panel 1702, to form the recesses of the passive interlock feature. Top corner panels 1744, 1746, 1748, 1750 are movable in that upon articulation of outside end panels 1724, 1726, those top corner panels move upwardly relative to top panel 1708, to form the projections that would be received in the recesses of a like tray that would be stacked atop a first such tray formed from blank 1702.

It is to be understood that the passive interlock structure may be located on any number of the "corners" of a container, from all the corners, to only one, and if situated on more than one corner, may have substantially different configurations on one or more of the corners, such that, for example, while the recesses and projections on one corner may have substantially diagonal edges, the recesses and projections on another corner may have concave arcuate edges; with convex arcuate edges on another corner. This would have the effect of also causing "front- or back-facing forward" or "front-only facing forward" types of alignment to occur for aligned and registered stacking, depending upon whether any form of symmetry is produced in the containers. In addition, other shapes for the die cuts may be employed, such as sawtooth, sine wave, etc., as may be desired, or permitted by the requirements of any particular application, without departing from the scope of the present invention.

Common to substantially all of the embodiments discussed herein (except those in which prominent stacking tabs are used), alignment and positive registration of like containers is accomplished simply by placing one "right-side up" container on top of another. A slight amount of lateral sliding or rotation of the upper container relative to the lower container will quickly bring the complementary "recess" and "projection" interlock regions into registration, which will cause the upper container to "seat" itself, in an aligned manner on the lower container, with a minimum of effort, potentially even without requiring the "stacker" to actually be looking at the interface between the stacked containers, during the registration process.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

We claim:

1. A container, formed from an articulated, initially flat blank of container material, said container comprising:

a bottom panel;

at least one side panel, emanating from a side edge region of the bottom panel and having a first fold line extending at least partially therebetween;

at least one end panel, emanating from an end edge region of the bottom panel and having a second fold line extending at least partially therebetween, and the second fold line extending in an intersecting direction with respect to the first fold line;

at least one partial top panel, disposed opposite and at least substantially parallel to the bottom panel; and a passive interlock structure disposed in the bottom panel and the at least partial top panel, for enabling at least a region of the bottom panel of a first such container to be complementarily interfitted with at least a region of an at least partial top panel of a second such container, the passive interlock structure being operably configured so that a first such container can be stacked in an aligned manner atop a second such container, without requiring the first container to be raised substantially above, precisely aligned with and then placed directly down upon the second container, the passive interlock structure further inhibiting relative lateral movement therebetween the first and second containers, once such aligned stacking is attained, said passive interlock structure comprising:

at least one recess formed in at least one of the bottom panel and the at least partial ton panel; and at least one substantially planar projection formed in at least one of the bottom panel and the at least partial top panel, wherein at least one of the at least one recess and the at least one substantially planar projection is formed by a first secondary fold line extending at an acute angle with respect to one of the first fold line and the second fold line.

2. The container according to claim 1, wherein the recess has a planar, substantially transversely extending portion, extending substantially parallel to and vertically offset from the one of the bottom panel and the at least partial top panel, wherein the at least one substantially planar projection, is formed in a corresponding one of the at least partial top panel and the bottom panel of the container, said substantially planar projection having a substantially transversely extending portion, extending substantially parallel to and vertically offset from the one of the at least partial top panel and the bottom panel, and wherein the at least one recess is disposed opposite to, and in vertically spaced alignment with the at least one substantially planar projection, the at least one recess and the at least one substantially planar projection being further complementarily contoured, so that the at least one substantially planar projection of a first such container can be received within the at least one recess of a second such container stacked and aligned relative thereto.

3. The container according to claim 2, wherein the at least partial top panel emanates from a top edge region of a side panel, and has a third fold line extending at least partially therebetween, and further has an end panel emanating from an end edge region thereof, with a fourth fold line extending at least partially therebetween, the fourth fold line extending in an intersecting direction with respect to the third fold line;

wherein each said at least one recess is further formed by:

a die cut through the blank of container material, extending across a corner portion of one of the bottom panel and the at least partial top panel, the die cut extending to and through one of the first and second, or third and fourth fold lines, into the side and end panels adjacent said one of said bottom panel and said at least partial top panel: and a plurality of secondary fold lines, extending at an acute angle with respect to each of the first and second, or third and fourth, fold lines, at least one of the plurality of secondary fold lines being situated entirely within the boundaries of one of the side and end panels and adjacent the corner portion of the one of the bottom panel and the at least partial top panel;

whereupon folding of the side and end panels adjacent to said one of the bottom panel and the at least partial top panel, relative to said one of the bottom panel and the at least partial top panel, the die cut, the first and second or third and fourth fold lines, and the secondary fold lines cooperate to move the corner portion of the one of the bottom panel and the at least partial top panel out of plane with respect to a remaining portion of the one of the bottom panel and the at least partial top panel, toward an interior region of the container.

4. The container according to claim 3, wherein the die cut has a contour formed of: straight lines; curved lines; a combination of straight and curved lines.

5. The container according to claim 2, wherein the at least partial top panel emanates from a top edge region of a side panel, and has a third fold line extending at least partially therebetween, and further has an end panel emanating from an end edge region thereof, with a fourth fold line extending at least partially therebetween, the fourth fold line extending in an intersecting direction with respect to the third fold line;

wherein each at least one substantially planar projection, formed in a corresponding one of the at least partial top panel and the bottom panel of the container, is formed further by:

a die cut through the blank of container material, extending across a corner portion of one of the bottom panel and the at least partial top panel, the die cut extending to one of the first and second, or third and fourth fold lines, into the side and end panels adjacent said one of said bottom panel and said at least partial top panel; and a plurality of secondary fold lines, extending at an acute angle with respect to each of the first and second, or third and fourth, fold lines, at least one of the plurality of secondary fold lines being disposed within the corner portion of the one of the bottom panel and the at least partial top panel, between the first and second, or third and fourth fold lines;

whereupon folding of the side and end panels adjacent to said one of the bottom panel and the at least partial top panel, relative to said one of the bottom panel and the at least partial top panel, the die cut, the first and second or third and fourth fold lines, and the secondary fold lines cooperate to move the corner portion of the one of the bottom panel and the at least partial top panel out of plane with respect to a remaining portion of the one of the bottom panel and the at least partial top panel, away from an interior region of the container.

6. The container according to claim 5, wherein the die cut has a contour formed of: straight lines; curved lines; a combination of straight lines and curved lines.

7. The container according to claim 2, wherein the at least one at least partial top panel emanates from a top edge region of a side panel, and has a third fold line extending at least partially therebetween, and further has an end panel emanating from an end edge region thereof, with a fourth fold line extending at least partially therebetween, the fourth fold line extending in an intersecting direction with respect to the third fold line;

wherein each at least one substantially planar projection, formed in a corresponding one of the at least partial top panel and the bottom panel of the container, is further formed by:

the at least partial top panel comprising a web of blank material extending across only a corner portion of the top region of the container, leaving a central region of the top region of the container open and unenclosed, so that the at least partial top panel extends above and is not coplanar with top edges of adjacent side and end panels of the container.

8. The container according to claim 7, wherein the web of material has a free edge facing an interior region of the container that has a contour formed of: straight lines; curved lines; a combination of straight lines and curved lines.

9. The container according to claim 1, wherein the container is a wraparound style of container having one complete top panel and one complete bottom panel.

10. The container according to claim 1, wherein the container is a wraparound style of container having a complete bottom panel, and two substantially half-top panels.

11. The container according to claim 1, wherein the container is a substantially open-topped tray.

12. The container according to claim 11, wherein the tray is provided with corner reinforcing panels.

13. The container according to claim 1, further comprising at least one stacking tab aperture.

14. The container according to claim 1, further comprising at least one stacking tab structure.

15. The container according to claim 1, wherein the container further comprises at least one inclined side or end panel.

16. The container according to claim 1, wherein the container further comprises at least one side or end wall formed from at least one partial side or end panel folded over another at least one partial side or end panel.

17. The container according to claim 1, wherein the container further comprises at least one corner gusset structure.

18. The container according to claim 1, wherein the container further comprises at least one self-locking structure operably configured to enable the container to be maintained in a fully articulated configuration without the use of adhesive or fasteners.

19. A passive interlock structure for enabling the facilitated aligned stacking of containers, wherein the containers each include a bottom panel, at least one side panel, at least one end panel, and at least one at least partial top panel disposed opposite and at least substantially parallel to the bottom panel, the passive interlock structure comprising:

at least one recess, formed in one of the bottom panel and the at least partial top panel of a container, the recess having a planar, substantially transversely extending portion, extending substantially parallel to and vertically offset from the one of the bottom panel and the at least partial top panel; and at least one substantially planar projection, formed in a corresponding one of the at least partial top panel and the bottom panel of the container,the substantially planar projection having a substantially transversely extending portion, extending substantially parallel to and vertically offset from the one of the at least partial top panel and the bottom panel;

the at least one recess being disposed opposite to, and in vertically spaced alignment with the at least one substantially planar projection, the at least one recess and the at least one substantially planar projection being further complementarily contoured, so that the at least one substantially planar projection of a first such container can be received within the at least one recess of a second such container stacked and aligned relative thereto, wherein at least one of the at least one recess and the at least one substantially planar projection is formed by a first fold line on a blank of container material forming one of the first container and the second container, said first fold line extending at an acute angle with respect to a second fold line on the blank of container material, the passive interlock structure being operably configured so that a first container incorporating the passive interlock structure can be stacked in an aligned manner atop a second like container, without requiring the first container to be raised substantially above, precisely aligned with and then placed directly down upon the second container, the passive interlock structure further inhibiting relative lateral movement therebetween such first and second containers, once such aligned stacking is attained.

20. The passive interlock feature of claim 18, wherein the at least one recess is located in a corner region of one of the top and bottom, and the at least one substantially planar projection is located in a corner region of one of the bottom and top, respectively, of a container.

21. A container, formed from an articulated, initially fiat blank of container material, said container comprising:

a bottom panel;

at least one side panel emanating from a side edge region of the bottom panel and having a first fold line extending at least partially therebetween;

at least one end panel emanating from an end edge region of the bottom panel and having a second fold line extending at least partially therebetween, wherein the second fold line extends in an intersecting direction with respect to the first fold line;

a passive interlock structure disposed in the bottom panel for enabling at least a region of the bottom panel of a first such container to be complementarily interfitted with at least a region of an at least partial top panel of a second such container, said passive interlock structure comprising at least one of a recess and a substantially planar projection formed in the bottom panel; wherein the at least one of a recess and a substantially planar projection is formed by a first secondary fold line extending at an acute angle with respect to one of the first fold line and the second fold line.

* * * * *